US007412958B2

(12) United States Patent
Takahashi et al.

(10) Patent No.: US 7,412,958 B2
(45) Date of Patent: Aug. 19, 2008

(54) INTERNAL COMBUSTION ENGINE

(75) Inventors: Naoki Takahashi, Yokohama (JP); Yoshiaki Tanaka, Fujisawa (JP); Hideaki Mizuno, Yokohama (JP); Kenshi Ushijima, Kamakura (JP); Yoshimi Nunome, Yokosuka (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 11/637,185

(22) Filed: Dec. 12, 2006

(65) Prior Publication Data

US 2007/0137606 A1 Jun. 21, 2007

(30) Foreign Application Priority Data

Dec. 16, 2005 (JP) ..... 2005-362587

(51) Int. Cl.

| | |
|---|---|
| ***F02F 7/00*** | (2006.01) |
| ***F02B 75/18*** | (2006.01) |
| ***F02B 75/04*** | (2006.01) |
| ***F02D 15/04*** | (2006.01) |

(52) U.S. Cl. ..... 123/195 H; 123/195 R; 123/78 R; 123/78 E; 123/78 F; 123/48 R; 123/48 B

(58) Field of Classification Search ..... 123/195 R, 123/195 H, 195 A, 197.4, 58.1, 198 E, 78 E, 123/78 F, 48 R, 48 B, 78 BA; 74/595, 596
See application file for complete search history.

(56) References Cited

U.S. PATENT DOCUMENTS

| | | | | |
|---|---|---|---|---|
| 5,441,019 | A * | 8/1995 | Sayer et al. | 123/73 R |
| 2005/0078895 | A1 * | 4/2005 | Kanbe et al. | 384/432 |

FOREIGN PATENT DOCUMENTS

| | | | |
|---|---|---|---|
| EP | 1154134 | A2 | 11/2001 |
| EP | 1361350 | A2 | 11/2003 |
| EP | 1431617 | A1 | 6/2004 |
| EP | 1533495 | A2 | 5/2005 |
| JP | 2002-61501 | | 2/2002 |

* cited by examiner

*Primary Examiner*—Stephen K. Cronin
*Assistant Examiner*—Ka Chun Leung
(74) *Attorney, Agent, or Firm*—Global IP Counselors, LLP

(57) ABSTRACT

A piston-crank mechanism links crankpins of a crankshaft with piston pins of pistons by using a plurality of links. The piston-crank mechanism allows an upward inertia force produced near a top dead center of each piston to be smaller than a downward inertia force produced near a bottom dead center of the piston in order to reduce secondary vibration occurring during operation. In a four-cycle inline four-cylinder internal combustion engine, a total force of inertia forces exerted from adjacent cylinders to each of second and fourth crankshaft bearings becomes a downward force, which reinforces a downward force produced in response to combustion pressure. These second and fourth crankshaft bearings have a rigidity higher than the remaining crankshaft bearings.

18 Claims, 12 Drawing Sheets

FIG. 8A FIRST CRANKSHAFT BEARING 11a
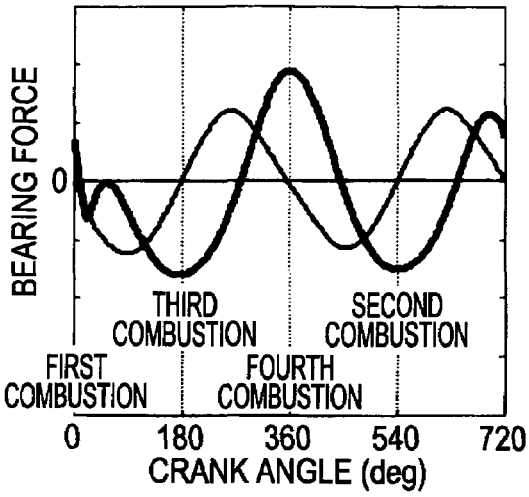
FIG. 8B SECOND CRANKSHAFT BEARING 11b
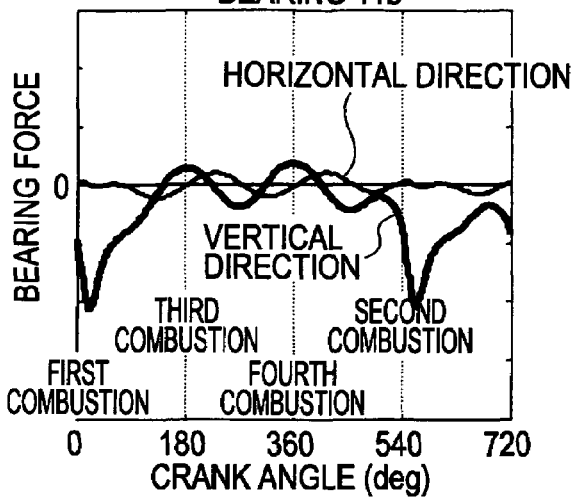
FIG. 8C THIRD CRANKSHAFT BEARING 11c
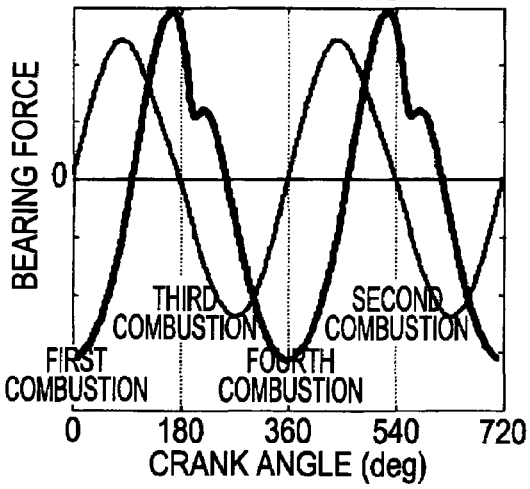
FIG. 8D FOURTH CRANKSHAFT BEARING 11d
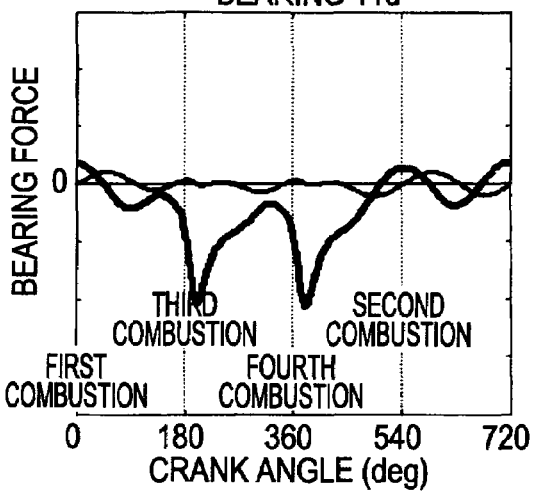
FIG. 8E FIFTH CRANKSHAFT BEARING 11e
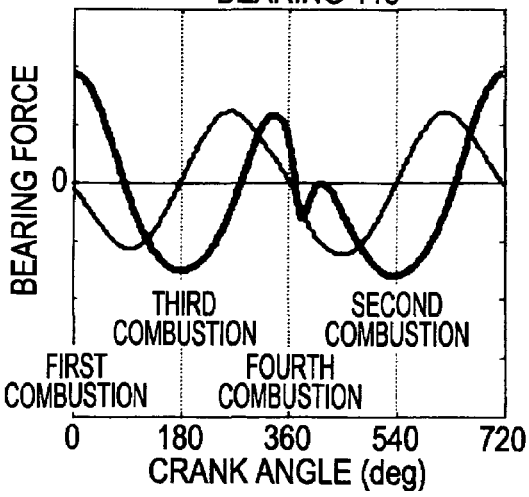

FIG. 9A FIRST CRANKSHAFT BEARING 11a
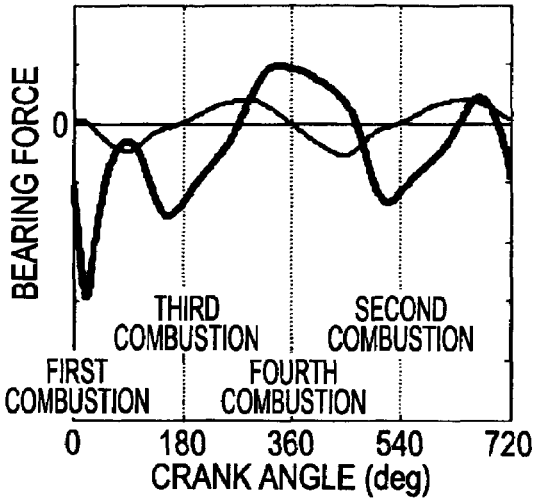
FIG. 9B SECOND CRANKSHAFT BEARING 11b
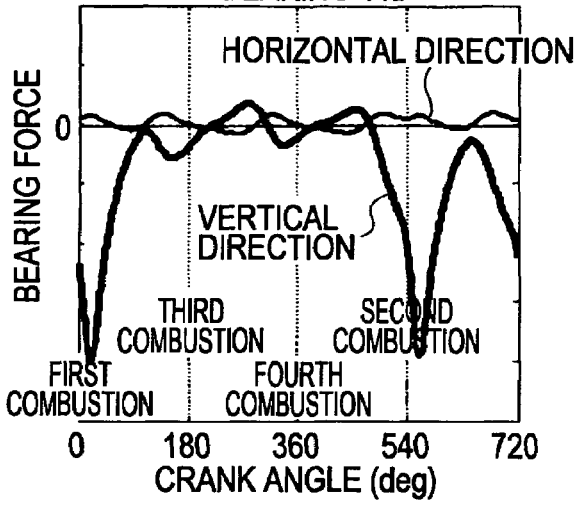
FIG. 9C THIRD CRANKSHAFT BEARING 11c
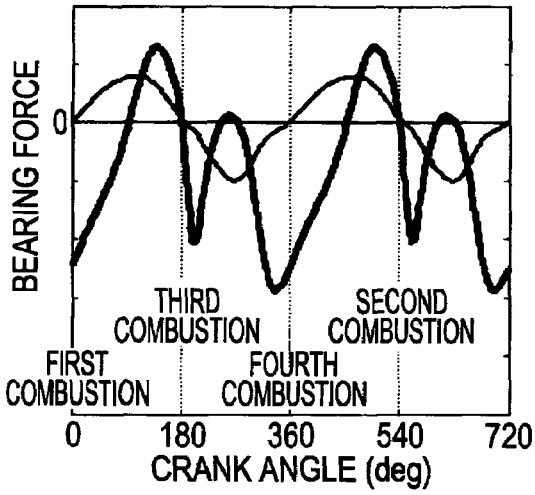
FIG. 9D FOURTH CRANKSHAFT BEARING 11d
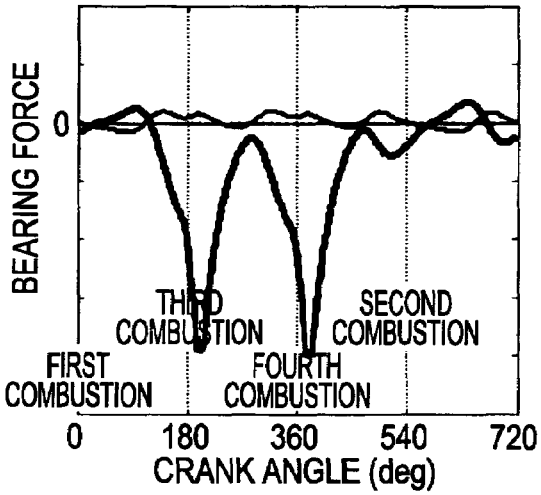
FIG. 9E FIFTH CRANKSHAFT BEARING 11e
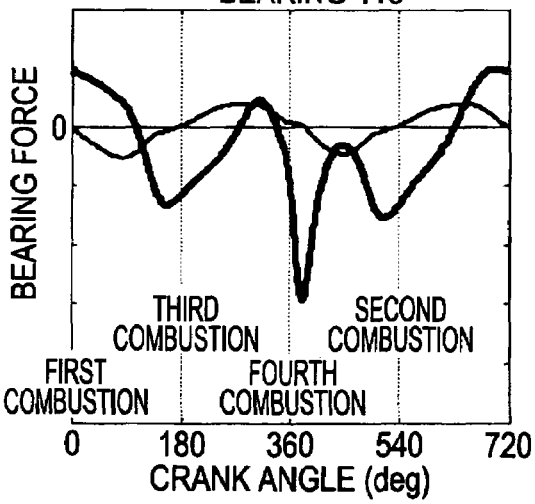

INTERNAL COMBUSTION ENGINE

CROSS-REFERENCE TO RELATED APPLICATIONS

This application claims priority from Japanese Patent Application Serial No. 2005-362587, filed 16$^{th}$ Dec. 2005, the entire contents of which are expressly incorporated herein by reference.

BACKGROUND OF THE INVENTION

1. Field of the Invention

The present invention generally relates to multi-cylinder internal combustion engines having a plurality of cylinders arranged in an array. In particular, the present invention relates to an improved crankshaft bearing structure suitable for an internal combustion engine equipped with a multilink-type piston-crank mechanism.

2. Background Information

Most internal combustion engines used in vehicles have a plurality of cylinders with a piston reciprocating in each of the cylinder and a crankshaft that is linked to the pistons by a piston-crank linking mechanism. Some internal combustion engines use a multilink-type piston-crank mechanism in which upper links are connected to piston pins of the pistons and lower links connect the upper links to crankpins of the crankshaft. One example of a multilink-type piston-crank mechanism is disclosed in Japanese Unexamined Patent Application Publication No. 2002-61501. In this type of multilink-type piston-crank, when the piston-stroke characteristics change, an excessive force acts on specific crankshaft bearings as a result of inertia force exerted on the crank bearings from crank rotating systems, thus making it difficult to attain sufficient bearing strength.

In view of the above, it will be apparent to those skilled in the art from this disclosure that there exists a need for an improved multilink-type piston-crank mechanism. This invention addresses this need in the art as well as other needs, which will become apparent to those skilled in the art from this disclosure.

SUMMARY OF THE INVENTION

One object of the invention to improve upon the above mentioned conventional technology. Other objects and advantages of the invention will become apparent from the following description, claims and drawings.

According to one aspect of the invention, an internal combustion engine is provided that basically comprises a cylinder block, a plurality of pistons, a crankshaft, a plurality of crankshaft bearings, a piston-crank mechanism and at least one of the plurality of crankshaft bearings. The cylinder block has a plurality of cylinders. One of the pistons is slidable disposed in one of the cylinders to move between a top dead center and a bottom dead center. Each of the pistons includes a piston pin. The crankshaft is disposed below the cylinders and extending in a direction in which the cylinders are arranged, the crankshaft including a plurality of journals and a plurality of crankpins disposed between adjacent pairs of the journals. The crankshaft bearings rotatably support the crankshaft on the cylinder block via the journals. The piston-crank mechanism links the crankshaft and the pistons together by the crankpins and the piston pins. The piston-crank mechanism is configured and arranged such that an upward inertia force is produced near the top dead center of each of the pistons that is smaller than a downward inertia force produced near the bottom dead center of the pistons. At least one of the plurality of crankshaft bearings is disposed between an adjacent pair of the cylinders. The adjacent pair of the cylinders have a relationship in which one of the pistons in one of the adjacent pair of the cylinders is near the top dead center when the other of the pistons in the other of the adjacent pair of the cylinders is near the bottom dead center. The at least one of the crankshaft bearings has a higher rigidity than the remaining ones of the crankshaft bearings.

Within the scope of this application it is envisaged that the various aspects, embodiments and alternatives set out in the preceding paragraphs, in the claims and in the following description may be taken individually or in any combination thereof.

BRIEF DESCRIPTION OF THE DRAWINGS

Referring now to the attached drawings which form a part of this original disclosure:

FIGS. 8A to 8E illustrate forces acting on crankshaft bearings included in an inline four-cylinder internal combustion engine equipped with a single-link-type piston-crank mechanism;

FIGS. 9A to 9E illustrate forces acting on crankshaft bearings included in an inline four-cylinder internal combustion engine equipped with a multilink-type piston-crank mechanism according to the comparative example;

DETAILED DESCRIPTION OF THE PREFERRED EMBODIMENTS

Figure 1:
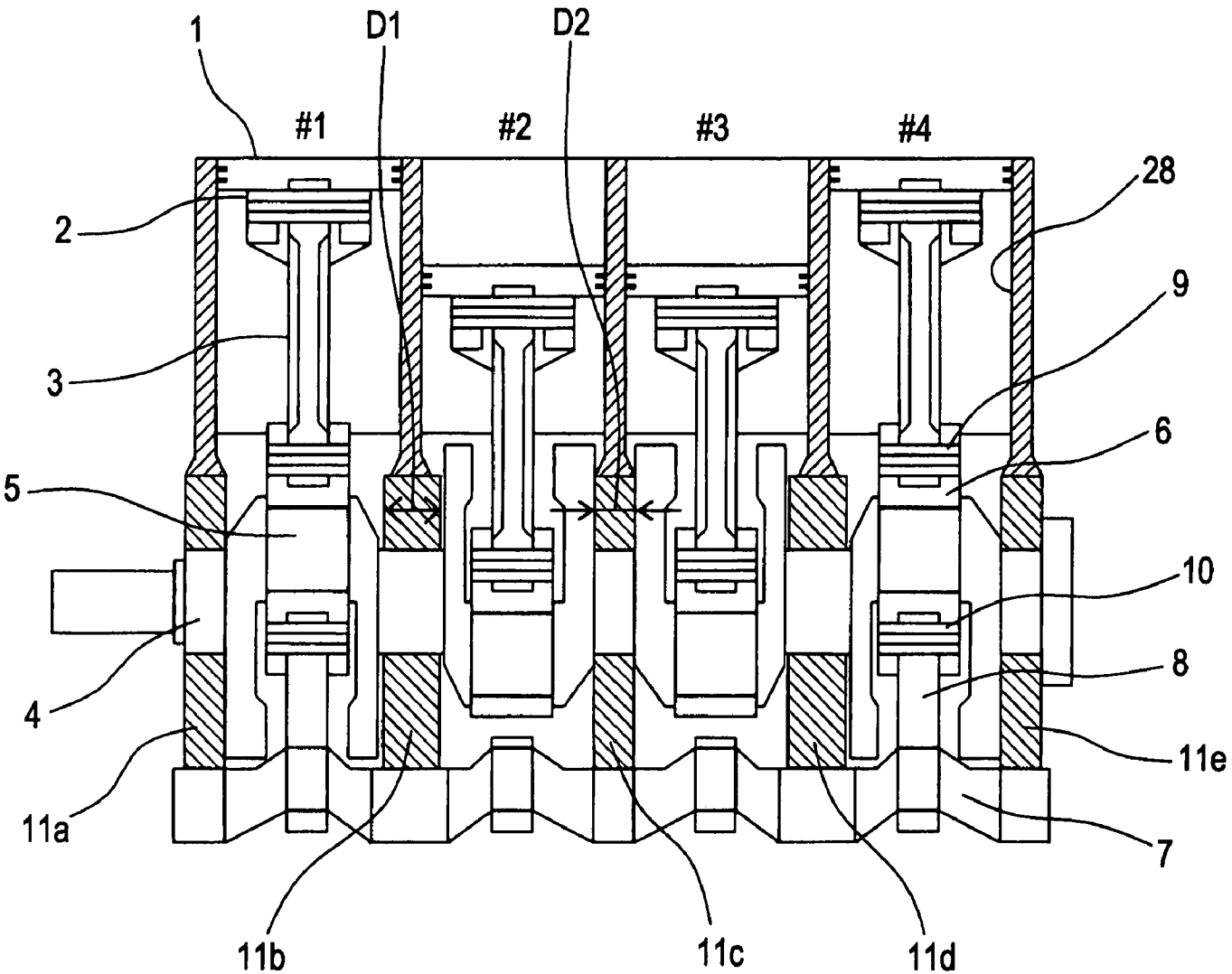
FIG. 1 shows a cross-sectional view of an inline four-cylinder multilink-type internal combustion engine according to a first embodiment of the present invention.

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Preferred embodiments of the present invention are described below with reference to the drawings. In the following description, the term "up" refers to the direction in which a piston moves towards its top dead center position (the similar terms "upward" or "upper" are to be construed in a similar manner) and the term "down" refers to the direction in which a piston moves towards its bottom dead centre position (the similar terms "downward", bottom" and "lower" are to be construed in a similar manner). The term "front-back direction" refers to the direction from the front to the back of an engine or the direction in which cylinders are arranged.

Generally, a cylinder block for a vehicle is made of a solid casting, and comprises a cylinder portion having a plurality of cylinders (i.e. cylinder bores) and a crankcase portion. The plurality of cylinders in the cylinder portion are arranged in the front-back direction of the engine (Note: the arrangement of the cylinders may alternatively be referred to as the cylinder-arrangement direction), and the crankcase portion covers a crankshaft that extends below the cylinder portion in the cylinder-arrangement direction and connecting rods connected to crankpins of the crankshaft.

The crankshaft has journals which are rotatably supported by the cylinder block by using crankshaft bearings. Each of the crankshaft bearings includes a partition- or film-like bulkhead that extends downward between adjacent cylinders from the lower end of the cylinder portion towards the inside of the crankcase portion, and a bearing cap that is fixed to the lower surface of the bulkhead while holding the corresponding journal of the crankshaft from opposite sides. The lower surface of each bulkhead and the upper surface of each bearing cap both have semicircular notches for rotatably supporting the corresponding journal of the crankshaft. Generally, each of the bulkheads is integrated with the cylinder block and has its opposite sides integrally joined to inner walls of the crankcase portion.

In an inline four-cylinder internal combustion engine, the first to fourth cylinders are arranged in that order from the front of the engine in the front-back direction of the engine. A total of five crankshaft bearings (constituted by the bulkheads and the bearing caps) are provided, three of which are disposed between adjacent cylinders, one of which is in front of the first cylinder (which is the front most cylinder of the engine), and one of which is behind the fourth cylinder (which is the rearmost cylinder of the engine). The five crankshaft bearings will be referred to as first to fifth crankshaft bearings in that order from the front of the engine. The thickness of the first to fifth crankshaft bearings, that is, the dimension thereof in the front-back direction of the engine, may be set such that the first and fifth crankshaft bearings at the front and back sides of the internal combustion engine are thinner than the remaining second to fourth intermediate crankshaft bearings. In that case, the three remaining second to fourth crankshaft bearings disposed between adjacent cylinders generally have the same dimension.

Figure 6:
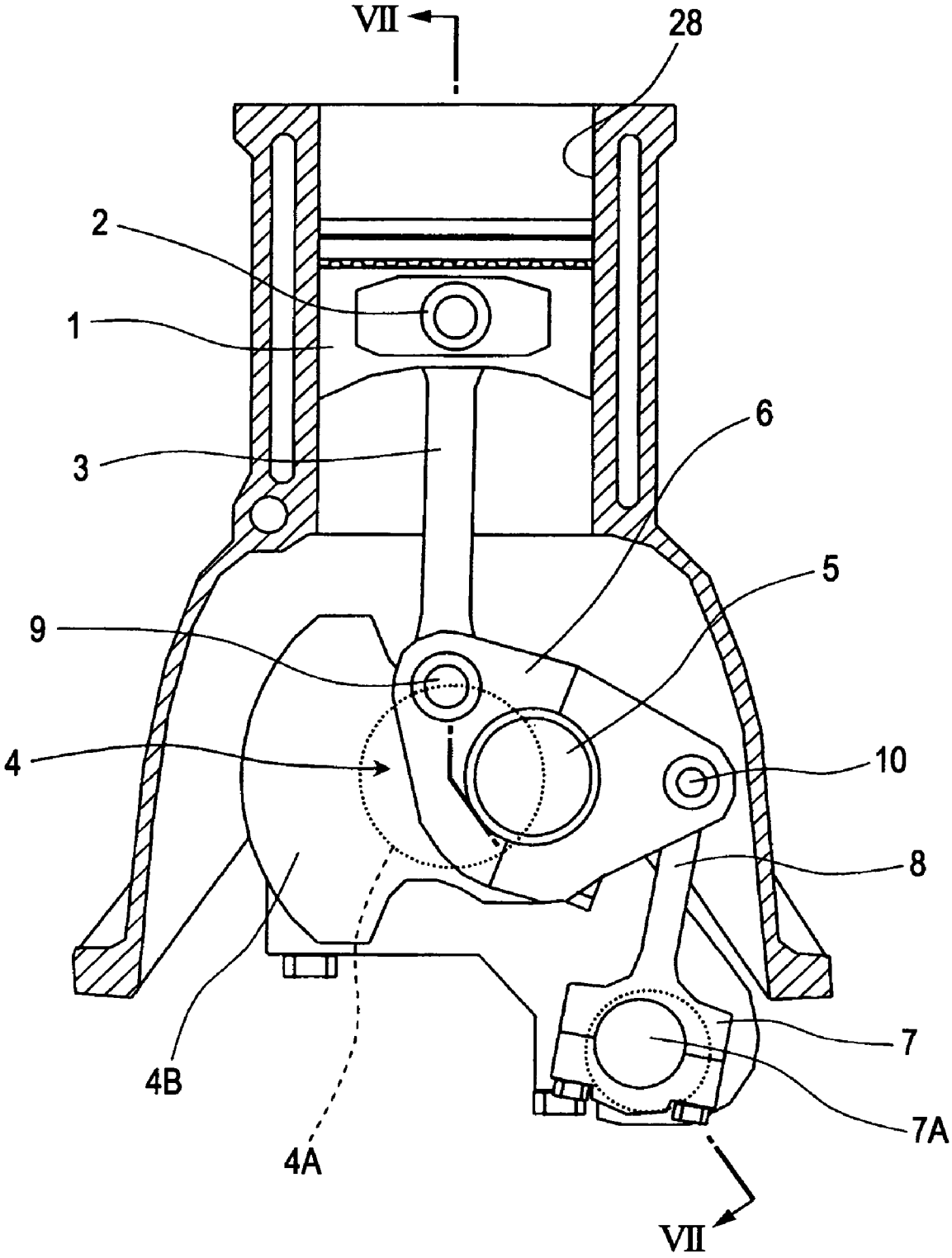
FIG. 6 illustrates a multilink-type piston-crank mechanism according to a comparative example to the present invention.
Figure 7:
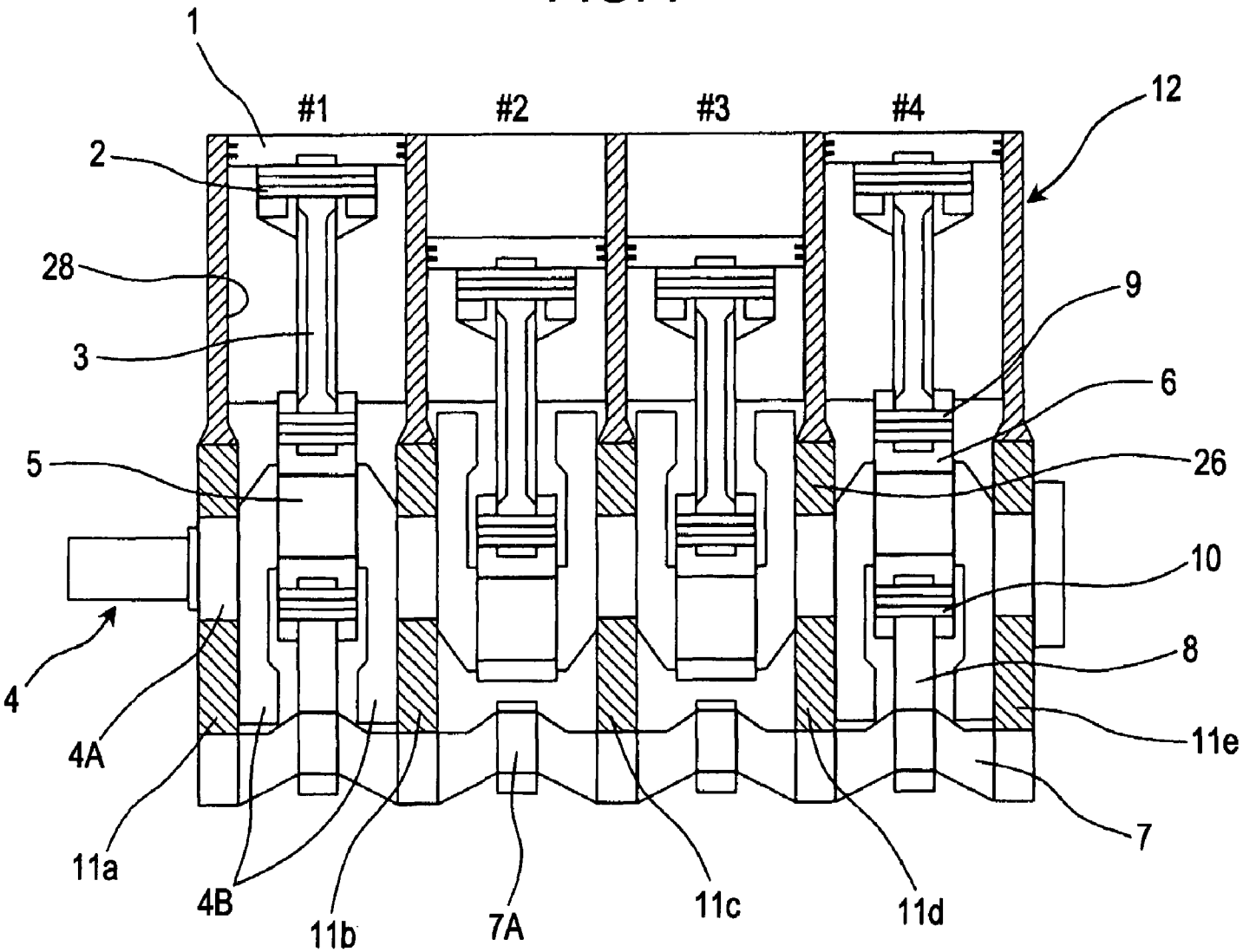
FIG. 7 is a cross sectional view taken along line VII-VII in FIG. 6.

FIG. 6 is a sectional view of an internal combustion engine equipped with a multilink-type piston-crank mechanism according to a comparative example. FIG. 7 is a sectional view taken along line VII-VII in FIG. 6. In FIG. 7, the front side of the internal combustion engine is on the left hand side of the Figure, and the cylinders are referred to as first to fourth cylinders in that order from left to right across the Figure (i.e. from the front to the back of the engine). The basic structure and effects of a multilink-type piston-crank mechanism (hereinafter referred to as a "multilink mechanism") are discussed in the aforementioned Japanese Unexamined Patent Application Publication No. 2002-61501. However, a basic description of such a mechanism is provided with reference to FIGS. 6 and 7 in which a multilink-type piston-crank mechanism comprises upper links 3 coupled to piston pins 2 of pistons 1, lower links 6 coupled to the upper links 3 and to crankpins 5 of a crankshaft 4, and control links 8 whose first ends are rockably supported by a cylinder block 12 about rocking fulcrums thereof and whose second ends are coupled to the lower links 6 so as to restrict the movement of the lower links 6.

In this mechanism, the piston pin of each piston and the corresponding crankpin of the crankshaft are linked to each other by using a plurality of links. By changing the restricting condition of one of the links, the top dead center position of the piston may be altered, thus allowing the engine compression ratio to be changed. Consequently, since the compression ratio can be controlled to an optimal value in accordance with the operating conditions of the engine, this mechanism contributes to higher efficiency and power and lower emissions for the internal combustion engine. It is further noted that by setting the links to appropriate dimensions and layouts, appropriate piston-stroke characteristics can be attained which are unattainable with a single-link type mechanism in which each piston pin and the corresponding crankpin are linked by using a single link (i.e. a connecting rod). Specifically, in comparison to a single-link type mechanism, the acceleration of each piston in a multilink mechanism is lower near the top dead center of the piston. This mechanism therefore effectively reduces secondary vibration that can occur during operation of the engine.

The multilink mechanism is also provided with compression-ratio changing mechanism for changing the compression ratio of the engine. Specifically, the compression-ratio changing mechanism can alter the position of the rocking fulcrum for each control link 8 and can thus change the restricting condition for the movement of the corresponding lower link 6. Altering the position/restricting condition in this manner alters the position of the top dead center of the corresponding piston 1 which therefore changes the engine compression ratio.

The compression-ratio changing mechanism comprises a control shaft 7 which is disposed diagonally below and parallel to the crankshaft 4 and is rotatably supported by the cylinder block 12, a plurality of control cams 7A (four control cams 7A in this example) provided on the control shaft 7 in correspondence to the cylinders, and a variable-compression-ratio actuator 31 (see FIG. 3) for changing or maintaining the rotation angle of the control shaft 7. Each of the control cams 7A has a circular periphery surface to which a lower end of the corresponding one of the control links 8 is rotatably attached.

The center of each control cam 7A, which serves as a rocking fulcrum for the corresponding control link 8, is eccentric to the center of rotation of the control shaft 7. Consequently, the position of the rocking fulcrum for each control link 8 with respect to the cylinder block 12 alters depending on the rotational position of the control shaft 7, thus changing the distance between the corresponding crankpin 5 and the corresponding piston pin 2. The upper links 3 and the lower links 6 are coupled to each other by using upper pins 9, and the control links 8 and the lower links 6 are coupled to each other by using control pins 10.

In a case where the multilink mechanism is not equipped with such a compression-ratio changing function, the control shaft 7 is given a simplified structure that does not have the control cams 7A disposed eccentrically to the center of rotation of the control shaft 7. In that case, the control links 8 may be rotatably attached to the control shaft 7.

The crankshaft 4 comprises five (main) journals 4A that are rotatably supported by the cylinder block 12 by using five respective crankshaft bearings 11*a* to 11*e*, and a total of four crankpins 5 disposed between adjacent journals 4A. Moreover, the journals 4A and the crankpins 5 have balance weights 4B disposed therebetween.

Figure 13:
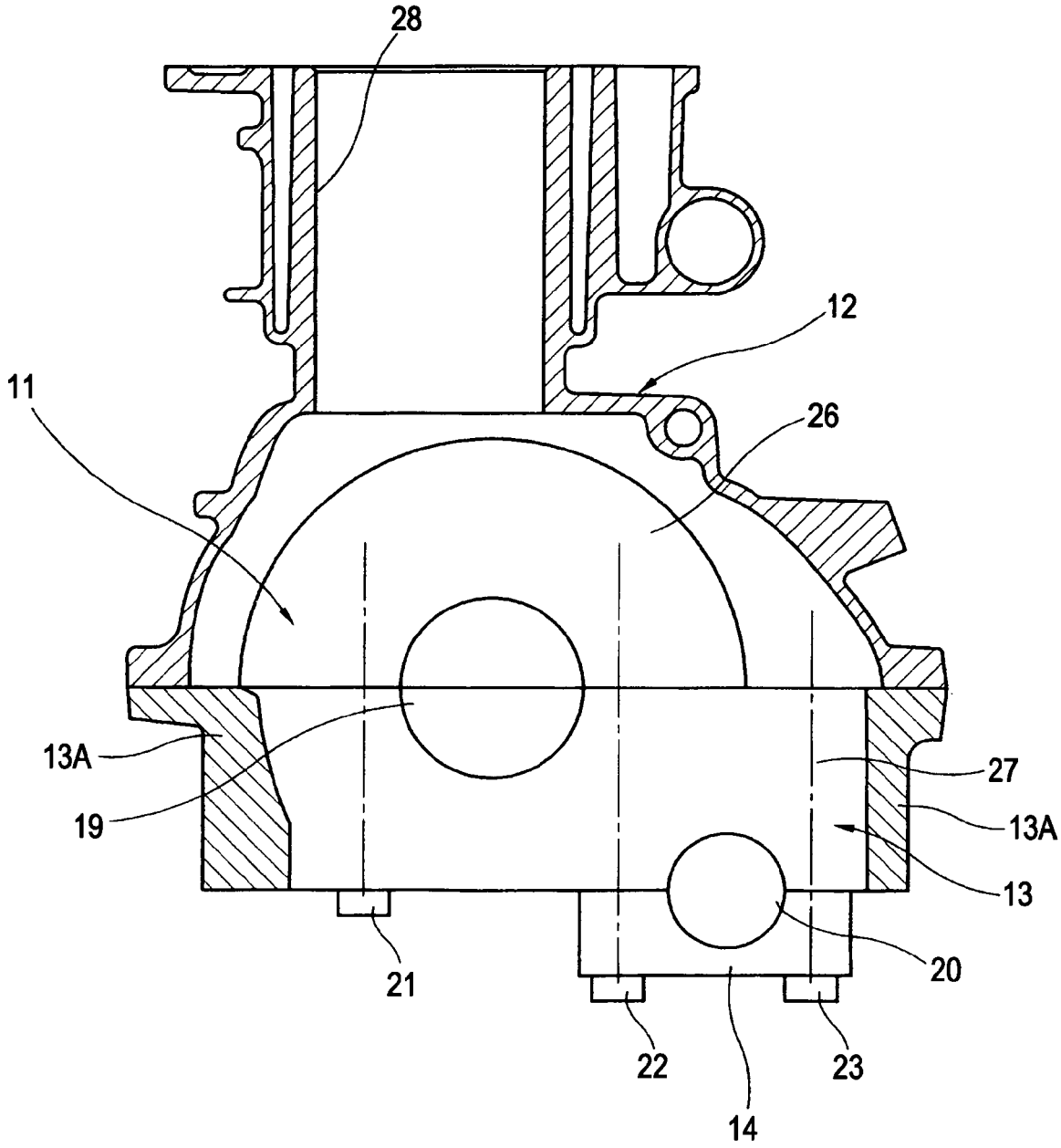
FIG. 13 is a vertical cross sectional view of a crankshaft bearing structure in an internal combustion engine.

As also shown in FIG. 13, each crankshaft bearing 11 comprises a bulkhead 26 provided in the cylinder block 12 and a first bearing cap 27 of a ladder frame 13, which is securely fastened to the lower surface of the bulkhead 26 with bolts 21 to 23. The lower surface of the bulkhead 26 and the upper surface of the first bearing cap 27 have semi-cylindrical bearing notches that constitute a bearing surface 19 for rotatably supporting the crankshaft 4.

The cylinder block 12 is made of a solid casting and includes a plurality of cylinders, namely, cylinder bores 28 arranged in the front-back direction of the engine, which is the cylinder-arrangement direction. The bulkheads 26 are integrated with the cylinder block 12 and are partition- or film-like bulkheads that extend downward between adjacent cylinder bores 28 from the lower end of the cylinder bores 28. Moreover, the opposite sides of each bulkhead 26 are integrally joined to inner walls of the cylinder block 12.

The ladder frame 13 has a lattice-like or ladder-like skeletal structure of high strength, and includes a plurality of first bearing caps 27 integrally linked to each other. Opposite side walls 13A of the ladder frame 13 are respectively fixed to lower surfaces of the opposite side walls of the cylinder block 12.

The ladder frame 13 and the cylinder block 12 can therefore be viewed as together defining a part of the outline of the internal combustion engine. For this reason, the cylinder block 12 is sometimes referred to as an upper block and the ladder frame 13 is referred to as a lower block. The lower side of the ladder frame 13 has second bearing caps 14 fastened thereto with the bolts 22 and 23. Each of the second bearing caps 14 holds the control shaft 7 from opposite sides. The lower surface of the ladder frame 13 and the upper surface of each second bearing cap 14 have semi-cylindrical notches that constitute a control-shaft bearing surface 20 for rotatably supporting the control shaft 7.

Excluding highly rigid bearing caps 14*a*, which are described in greater detail below, the ladder frame 13 and the cylinder block 12 are joined to each other with the bolt (21) that is farthest from the control shaft 7. With the two bolts 22 and 23 on opposite sides of the control shaft 7, the ladder frame 13 and each second bearing cap 14 are fastened together securely to the cylinder block 12.

FIGS. 8A to 8E and FIGS. 9A to 9E illustrate fluctuations in the bearing force that acts on the first to fifth crankshaft bearings 11*a* to 11*e* (i.e. the bulkheads) in dependence with crank angle when the inline four-cylinder internal combustion engine operates at high speed and high load. In other words, FIGS. 8A to 8E and 9A to 9E show fluctuations in force acting in the up-down direction (vertical direction) of the pistons in accordance with the crank angle when the inline four-cylinder internal combustion engine operates at high speed and high load.

FIGS. 8A to 8E show characteristics of an internal combustion engine equipped with a single-link-type piston-crank mechanism (which hereinafter is referred to as a "single-link mechanism") in which each piston pin and the corresponding crankpin are linked to each other with a single link, namely, a connecting rod.

FIGS. 9A to 9E show characteristics of an internal combustion engine equipped with the multilink mechanism. An internal combustion engine of this type is hereinafter referred to as a "multilink engine".

It is noted that the engine displacement and operating conditions are the same between the single-link and the multilink engines. In each engine, the cylinders are ignited at 180° crank-angle intervals in the following order: first cylinder, third cylinder, fourth cylinder, and second cylinder. The differences obtained by comparing FIGS. 8A to 8E and FIGS. 9A to 9E are described below.

The bearing force applied to each crankshaft bearing, particularly, the maximum value of the bearing force, varies depending on the design parameters of the internal combustion engine. The design parameters may, for example, include the magnitude of the maximum internal pressure of the cylinders, the maximum revolving speed, and the mass of the moving elements. If the internal combustion engine is to be used in a vehicle, the following differences may occur between a single-link engine and a multilink engine. According to the single-link engine in FIGS. 8A to 8E, the maximum values of the bearing force received by the second and fourth crankshaft bearings 11*b* and 11*d* counted from the front of the engine are about the same as or smaller than the maximum value of the bearing force received by the third crankshaft bearing 11*c* counted from the front of the engine. In contrast, according to the multilink engine in FIGS. 9A to 9E, the maximum values of the bearing force received by the second and fourth crankshaft bearings 11*b* and 11*d* counted from the front of the engine are greater than the maximum value of the bearing force received by the third crankshaft bearing 11*c* counted from the front of the engine. In other words, of the second to fourth crankshaft bearings 11*b* to 11*d* that are each disposed between two adjacent cylinders, the second and fourth crankshaft bearings 11*b* and 11*d* experience the highest maximum bearing forces.

Figure 10:
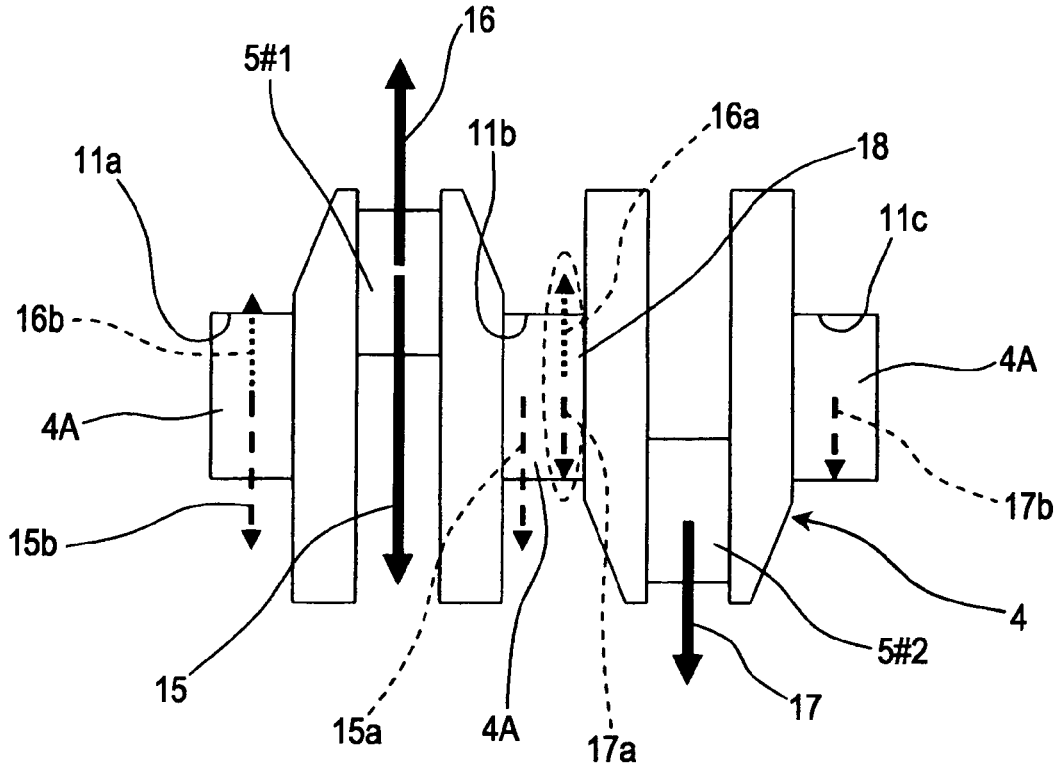
FIG. 10 is a part of the crankshaft in which forces acting on a crankshaft resulting from combustion pressure in first and second cylinders of the single-link engine shown in FIGS. 8A to 8E.
Figure 11:
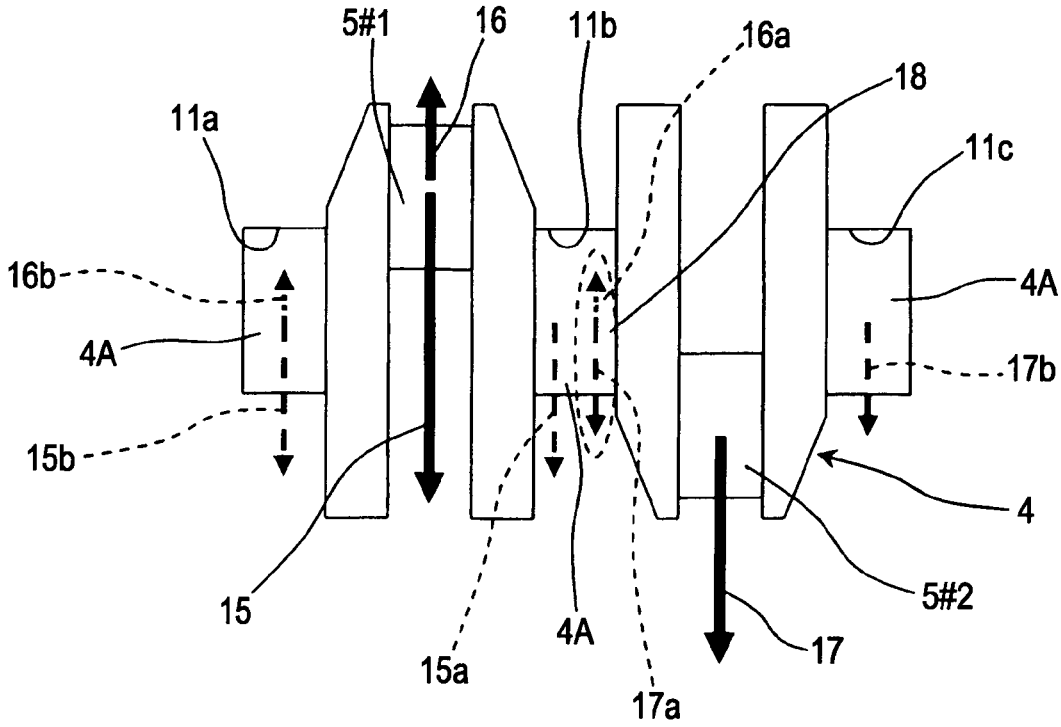
FIG. 11 is a part of the crankshaft in which forces acting on a crankshaft resulting from combustion pressure in first and second cylinders of the multilink engine shown in FIGS. 9A to 9E.

The reason for such differences in the bearing forces operative on the bearings occur is described below. As shown in FIGS. 8A to 8E and FIGS. 9A to 9E, one of the points at which the second crankshaft bearing 11*b* receives a maximum force is at the point of combustion for the first cylinder (i.e. near the top dead center for compression). FIGS. 10 and 11 illustrate crank throws of the crankshaft 4 for the first and second cylinders at this timing position, and show what kind of forces are acting on the crankshaft 4 and are transmitted to the cylinder block 12 at the combustion timing of the first cylinder. FIG. 10 corresponds to the single-link engine, and FIG. 11 corresponds to the multilink engine. Of the three journals 4A of the crankshaft 4 shown, the middle journal 4A is supported by the second crankshaft bearing 11*b*.

Referring again to FIGS. 10 and 11, a downward combustion force 15 and an upward inertia force 16 are shown acting on a crankpin 5#1 in the first cylinder. At the same time, a downward inertia force 17 is shown acting on a crankpin 5#2 in the second cylinder. Although an upward force should also be produced in the second cylinder due to internal pressures therein, such an upward force may be ignored since it is too small to be compared with the inertia forces and the combustion force. Assuming that the force received by each crankpin is uniformly transmitted to the adjacent crankshaft bearings, the second crankshaft bearing 11*b* receives a downward force component 15*a*, which is half the combustion force 15 in the first cylinder, an upward force component 16*a*, which is half the inertia force 16 of the first cylinder, and a downward force component 17*a*, which is half the inertia force 17 of the second cylinder. In this case, the term "inertia force" refers to an inertia force of a corresponding crank rotating mass system which includes the upper links 3 and the lower links 6 in addition to the pistons 1 and the crankshaft 4. It is noted that the inertia force is basically inversely proportional to the acceleration of the pistons 1.

Referring to FIG. 10, due to the structure of the single-link engine, the upward inertia force 16 of the first cylinder is naturally greater than the downward inertia force 17 of the second cylinder. Accordingly, the total force 18 of the inertia forces of the first and second cylinders (i.e. the sum of the inertia forces of the first and second cylinders) acting on the second crankshaft bearing 11*b* becomes an upward force, whereby the total upward force 18 and the downward combustion force component 15*a* counterbalance each other.

On the other hand, in the multilink engine shown in FIG. 11, the piston acceleration near the top dead center of each piston is set lower than that near the bottom dead center thereof in order to reduce secondary vibration occurring during operation. The magnitude relationship between the inertia force 16 of the first cylinder and the inertia force 17 of the second cylinder is the opposite to that of the single-link engine shown in FIG. 10. In detail, the downward inertia force 17 of the second cylinder has greater magnitude than the upward inertia force 16 of the first cylinder. Thus, the total force 18 of the inertia forces of the first and second cylinders (i.e. the sum of the inertia forces of the first and second cylinders) acting on the second crankshaft bearing 11*b* becomes a downward force, which reinforces the downward combustion force 15.

Figure 12:
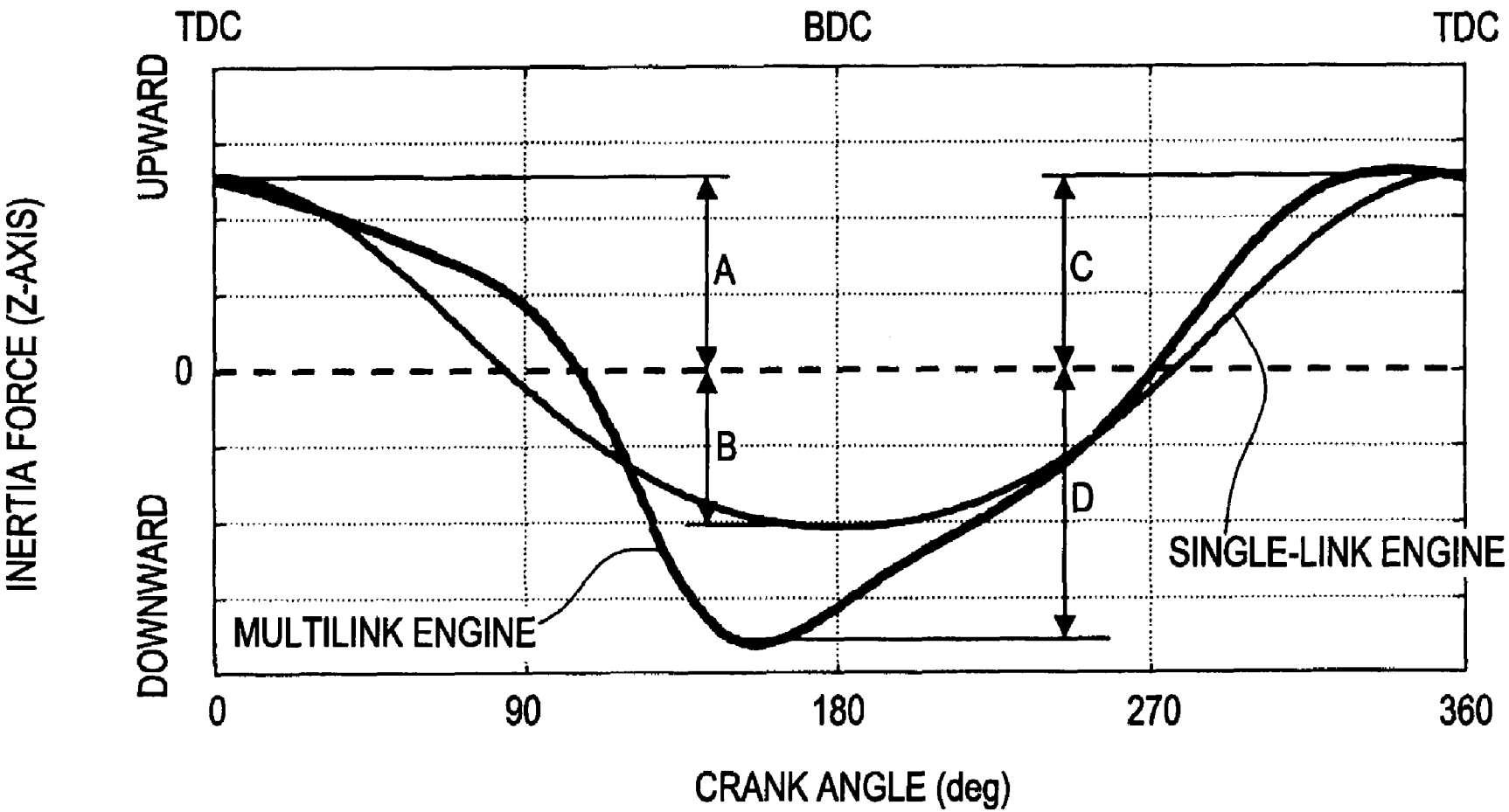
FIG. 12 is a characteristic diagram illustrating fluctuations in inertia force of one cylinder with respect to a crank angle in the single-link engine and the multilink engine.

The difference in the relationship between the inertia force and the combustion pressure is caused by a difference in the inertia force characteristics of a cylinder between the single-link and the multilink engines. In view of a crank throw of one cylinder, FIG. 12 shows the inertia force (i.e. a total inertia force of one cylinder) transmitted to the corresponding crankshaft bearing 11 of the cylinder block 12 from the corresponding journal 4A of the crankshaft 4 with respect to the crank angle. FIG. 12 illustrates upward and downward force components of an inertia force of one cylinder in a single-link engine and a multilink engine. For the single-link engine, due to its structure, the downward acceleration of each piston near the top dead center thereof is greater than the upward acceleration of the piston near the bottom dead center thereof. Thus, the upward inertia force at the top dead center of each piston, namely, a maximum upward inertia force value (A), is greater than the downward inertia force at the bottom dead center of the piston, namely, a maximum downward inertia force value (B).

In contrast, in the multilink engine, the piston acceleration near the top dead center of each piston is set lower than that near the bottom dead center in order to reduce secondary vibration occurring during operation. Thus, the upward inertia force near the top dead center of each piston, namely, a maximum upward inertia force value (C), is smaller than the downward inertia force near the bottom dead center of the piston, namely, a maximum downward inertia force value (D). If such piston-stroke characteristics are adapted to a four-cycle inline four-cylinder internal combustion engine, a typical problem that may occur is one in which a particularly large maximum force acts on the second and fourth crankshaft bearings 11*b* and 11*d*.

Another of the points, within one engine cycle of the internal combustion engine, at which the second crankshaft bearing 11*b* receives a maximum force is at the point of timing equal to the combustion timing for the second cylinder. In this case, the forces exerted on the second crankshaft bearing 11*b* from the first cylinder side and second cylinder side are inverted relative to the above description. Moreover, it is noted that the force characteristics of the fourth crankshaft bearing 11*d* are substantially similar to the force characteristics of the second crankshaft bearing 11*b*, and are different only in that the maximum-force timings (crank angles) are different between the two in accordance with the different combustion timings for the cylinders.

Based on the difference in force characteristics described above, for the single-link engine, there is no problem in setting substantially the same strength and rigidity for the second, third, and fourth crankshaft bearings 11*b* to 11*d* (as measured from the front of the engine). However, for the multilink engine, if the second to fourth crankshaft bearings 11*b* to 11*d* are given the same rigidity, the second and fourth crankshaft bearings 11*b* and 11*d* that locally receive a force of large magnitude may lack bearing strength or may need to be increased in weight and size in order to attain sufficient bearing strength.

In view of these circumstances, in the first to fourth embodiments to be described below, the second and fourth crankshaft bearings 11*b* and 11*d* are given higher rigidity than the remaining crankshaft bearings 11*a*, 11*c* and 11*e*. These crankshaft bearings having higher rigidity will hereinafter be referred to as "highly-rigid bearings". In the embodiments to be described below, the basic structure of the multilink-type piston-crank mechanism is the same as that of the example shown in relation to FIGS. 6 and 7. Therefore, redundant descriptions will be omitted where appropriate.

A first embodiment of the present invention will now be described with reference to FIGS. 1 and 2. In the first embodiment, the crankshaft bearings (constituted by the bulkheads 26 and the first bearing caps 27) are given different dimensions, namely, thicknesses, in the front-back direction of the engine, in order to vary the rigidity of the crankshaft bearings. Specifically, according to the first embodiment shown in FIG. 1, in contrast to a conventional example in which the five crankshaft bearings 11*a* to 11*e* are of the same thickness, the dimension, D1, of-each of the highly-rigid bearings 11*b* and 11*d* serving as the second and fourth crankshaft bearings is set larger than the dimension, D2, of each of the remaining first, third, and fifth crankshaft bearings 11*a*, 11*c* and 11*e*. The highly-rigid bearings 11*b* and 11*d* therefore have a higher rigidity than the remaining crankshaft bearings 11*a*, 11*c* and 11*e*. Consequently, the bearing strength of the highly-rigid bearings 11*b* and 11*d* is increased and the force acting on the highly-rigid bearings 11*b* and 11*d* is substantially reduced which thereby reduces uneven forces acting on the crankshaft bearings 11*a* to 11*e*. In other words, the forces acting on the crankshaft bearings 11*a* to 11*e* are uniformized.

The mechanism for substantially reducing the maximum forces acting on the highly-rigid bearings 11*b* and 11*d* by using providing different rigidities is described below with reference to FIG. 2. Similar to the example described in relation to FIG. 11, FIG. 2 illustrates crank throws corresponding to the first cylinder and the second cylinder in an inline four-cylinder multilink engine and the forces acting on the crank throws at the timing (near the top dead center of a piston) at which the first cylinder generates a maximum combustion pressure. Although the first embodiment in FIG. 2 is basically similar to the example described in relation to FIG. 11, the crankshaft bearings 11*a* to 11*c* in the example of FIG. 11 have the same rigidity. Therefore, the inertia force 17 of the second cylinder is distributed as equal force components 17*a* and 17*b* to the neighboring second and third crankshaft bearings 11*b* and 11*c*. By contrast, in the first embodiment shown in FIG. 2, the crankshaft bearings 11*a* to 11*c* have different rigidities. Therefore, the inertia force 17 of the second cylinder is distributed as unequal force components 17*a* ave 17*b* to the neighboring second and third crankshaft bearings 11*b* and 11*c*. The combustion force and the inertia force acting on each crankpin 5 are distributed and transmitted to the corresponding crankshaft bearings via two adjacent journals. The distribution ratio is not exactly 1:1 or even, but fluctuates depending on the rigidity and deformation of the crankshaft and the crankshaft bearings. Specifically, if the third crankshaft bearing 11*c* is given lower rigidity, particularly, lower radial rigidity in the radial direction thereof, than the second crankshaft bearing 11*b*, the third crankshaft bearing 11*c* will become deformed by a greater degree. This causes a greater percentage of the force received by the crankpin 5#2 in the second cylinder to be distributed to the third crankshaft bearing 11*c*. In this case, the force component 17*a* of the inertia force of the second cylinder received by the second crankshaft bearing 11*b* is reduced. Therefore, with regard to the total force (sum) 18 of the inertia forces of the first cylinder and the second cylinder received by the second crankshaft bearing 11*b*, the effect of the upward inertia force component 16*a* of the first cylinder becomes relatively large, which means that the downward force weakens while the upward force strengthens. Accordingly, in comparison to the example shown in FIG. 11, the reinforcing relationship between the combustion pressure in the first cylinder and the total force 18 of the inertia forces of the first and second cylinders received by the second crankshaft bearing 11*b* is alleviated. Thus, the downward force acting on the second crankshaft bearing 11*b* decreases, whereby the maximum downward force acting on the second crankshaft bearing 11*b* can be effectively reduced.

Although the above description is directed to a mechanism corresponding to the combustion timing for the first cylinder, the force acting on the second crankshaft bearing 11*b* also reaches a maximum value at the combustion timing for the second cylinder. In that case, the force mechanism is inverted between the first cylinder side and the second cylinder side in FIG. 2. In other words, by reducing the rigidity of the first crankshaft bearing 11*a*, the downward inertia force of the first cylinder transmitted to the second crankshaft bearing 11*b* becomes smaller than the downward inertia force of the first cylinder transmitted to the first crankshaft bearing 11*a*. As a result, the force acting on the second crankshaft bearing 11*b* at the combustion timing for the second cylinder can be reduced. A similar mechanism may be used for reducing the force acting on the fourth crankshaft bearing 11*d*.

Figure 3:
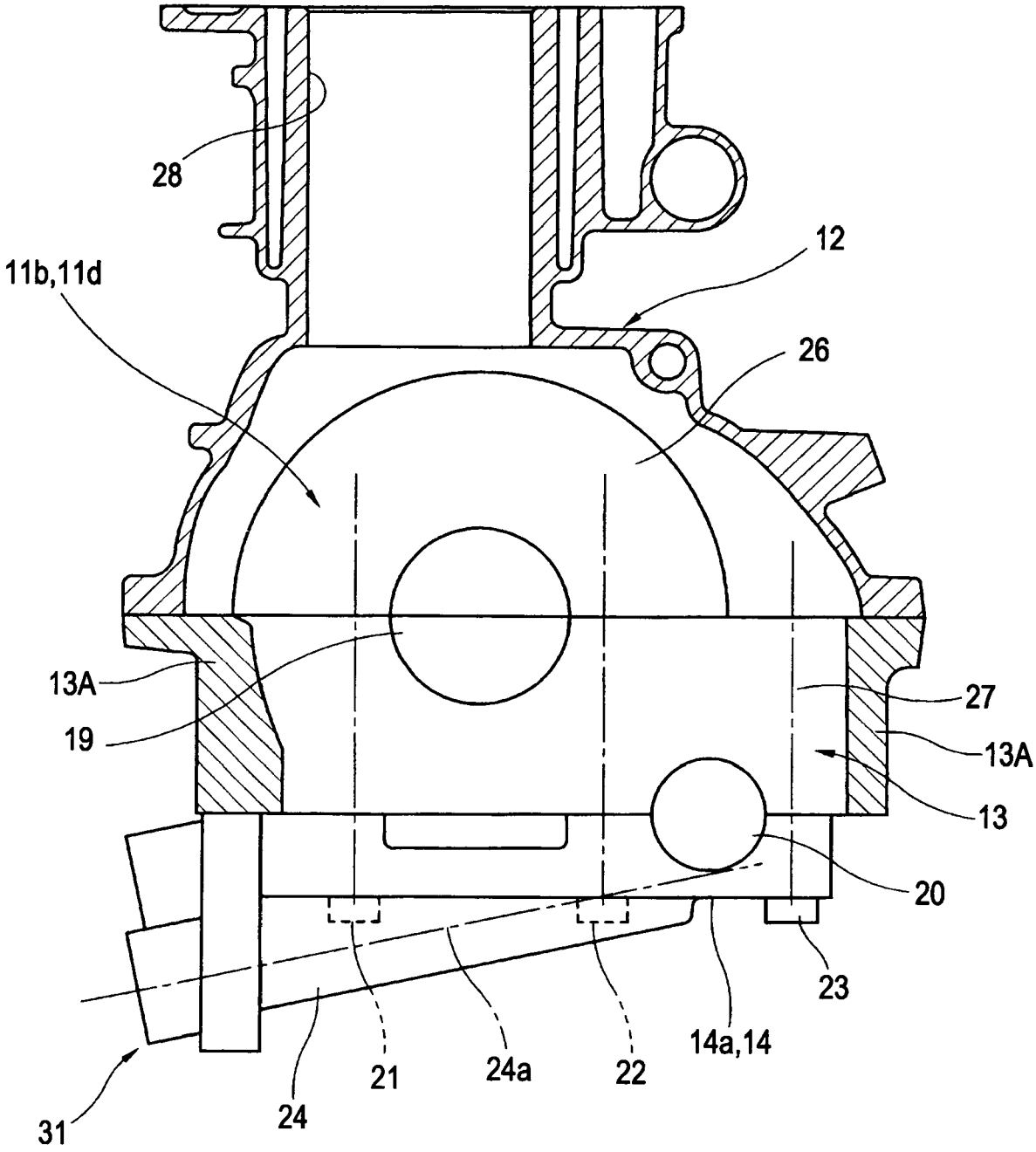
FIG. 3 shows a vertical cross sectional view of a crankshaft bearing structure in an internal combustion engine according to a second embodiment of the present invention.

FIG. 3 illustrates a second embodiment of the present invention, and is a sectional view of the highly-rigid bearings 11*b* and 11*d* included in the multilink-type internal combustion engine. Components shown in FIG. 3 that are the same as those in FIG. 13 are given the same reference numerals, but FIG. 3 is different from FIG. 13 in that the highly-rigid bearings 11*b* and 11*d* each have a housing 24 of the variable-compression-ratio actuator 31 fastened thereto. The variable-compression-ratio actuator 31 has a feed screw and a rod within the housing 24. The rod moves slantwise in the left-right direction of FIG. 3 along an axis line 24*a* so as to change the rotation angle of the control shaft 7 connected to the right end of the rod, thereby changing the compression ratio of the internal combustion engine. Since the housing 24 is fastened to each of the highly-rigid bearings 11*b* and 11*d*, the housing 24 can function as a reinforcing member so as to significantly increase the rigidity of each highly-rigid bearing 11*b* and 11*d*, particularly, the rigidity thereof in the vertical direction of the pistons. In the second embodiment, the rigidity of the second and fourth crankshaft bearings 11*b* and 11*d* can be increased to effectively reduce the force received by the bearings 11*b* and 11*d* without giving the crankshaft bearings different thicknesses as in the first embodiment.

Figure 4:
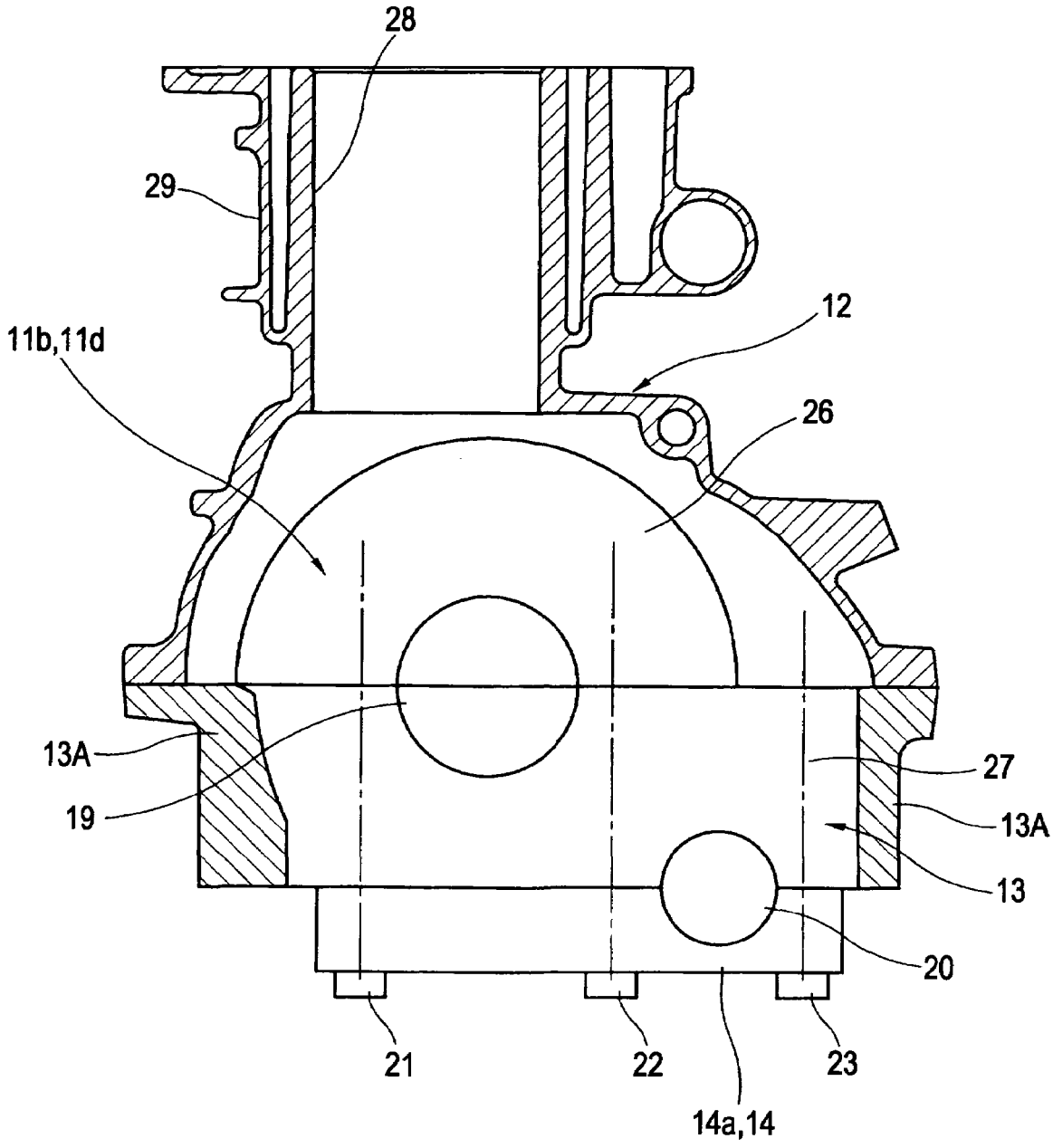
FIG. 4 shows a vertical cross sectional view of a crankshaft bearing structure in an internal combustion engine according to a third embodiment of the present invention.

FIG. 4 illustrates a third embodiment of the present invention, and is a sectional view of the highly-rigid bearings 11*b* and 11*d* included in the multilink-type internal combustion engine. In the third embodiment, similar to the second embodiment in FIG. 3, of the plurality of second bearing caps 14 fastened to the lower surface of the ladder frame 13, second bearing caps 14*a* positioned below the highly-rigid bearings 11*b* and 11*d* are highly-rigid bearing caps that are longer in the width direction of the engine than the remaining second bearing caps 14 (see FIG. 13). In detail, each highly-rigid bearing cap 14*a* extends across a position below the corresponding crankshaft bearing surface 19 in the width direction of the engine, and is fastened to the cylinder block 12 together with the ladder frame 13 by using the three bolts 21, 22 and 23. Accordingly, the second bearing caps 14*a* positioned below the highly-rigid bearings 11*b* and 11*d* and having a dimension larger in the width direction of the engine than that of the remaining second bearing caps 14 (see FIG. 13) allow for higher rigidity of the highly-rigid bearings 11*b* and 11*d* in the radial direction thereof, particularly, higher rigidity in the vertical direction of the pistons. Thus, the force received by the second crankshaft bearing 11*b* and the fourth crankshaft bearing 11*d* can be substantially reduced without giving the crankshaft bearings different thicknesses as in the first embodiment. In the third embodiment, each of the first, third, and fifth crankshaft bearings 11*a*, 11*c* and 11*e* has the same structure as that shown in FIG. 13.

A modified embodiment of the second and third embodiments is also permissible. Specifically, the second bearing caps attached below the second crankshaft bearing 11*b* and the fourth crankshaft bearing 11*d* may be defined by highly-rigid bearing caps 14*a* having a larger dimension in the width direction of the engine than the remaining second bearing caps, and only one of the highly-rigid bearing caps 14*a* may have the housing 24 of the variable-compression-ratio actuator 31 mounted therebelow. This allows for an achievement of substantially the same effect as in the second and third embodiments.

Figure 5:
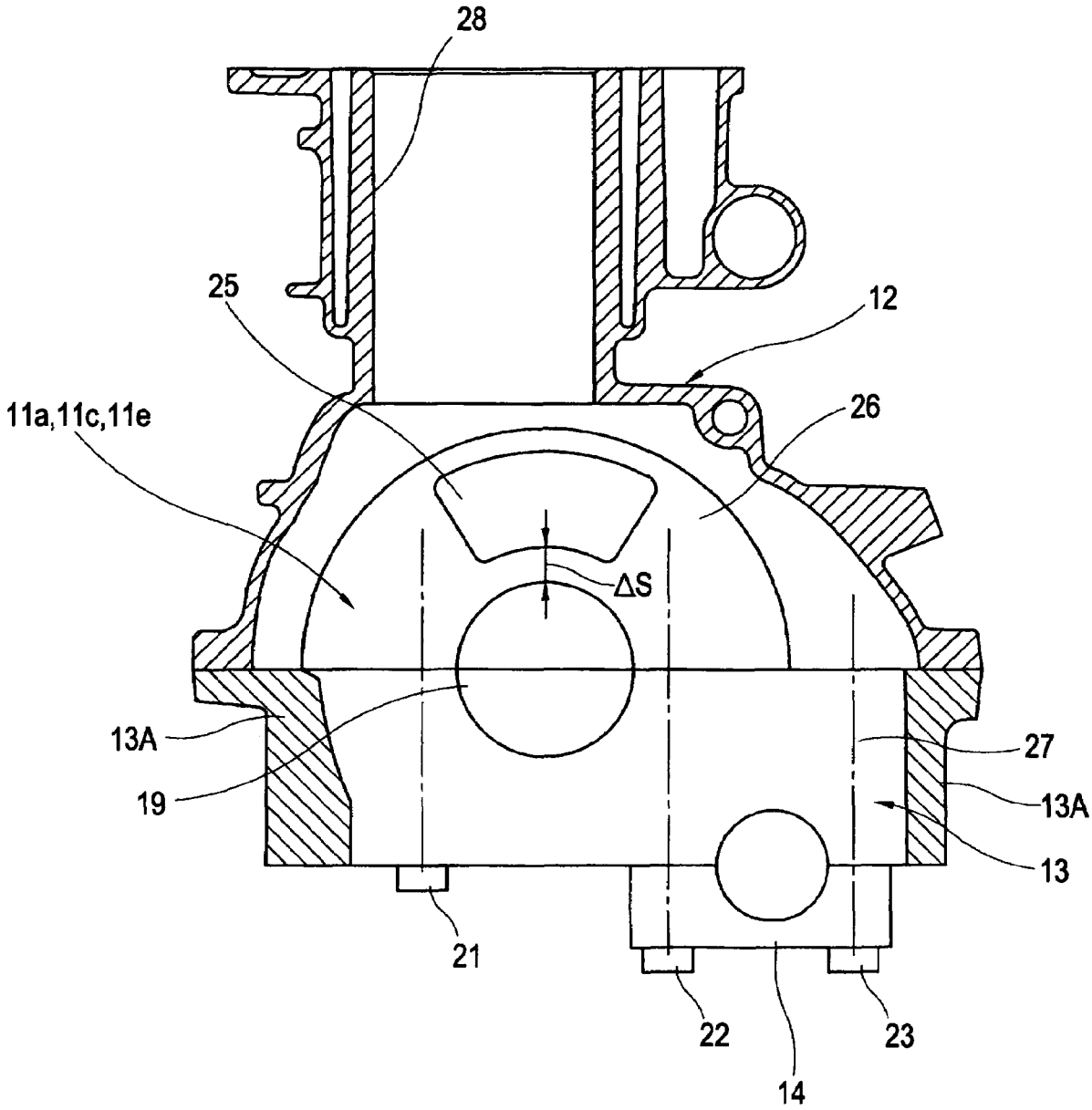
FIG. 5 shows a vertical cross sectional view of a crankshaft bearing structure in an internal combustion engine according to a fourth embodiment of the present invention.

FIG. 5 illustrates a fourth embodiment of the present invention, and is a sectional view of the first, third, and fifth crankshaft bearings 11*a*, 11*c* and 11*e* included in the multilink-type internal combustion engine. Components shown in FIG. 5 that are the same as those in FIG. 13 are given the same reference numerals, but FIG. 5 is different from FIG. 13 in that the side surfaces of the bulkheads 26 of the crankshaft bearings 11*a*, 11*c* and 11*e* in the front-back direction of the engine are partially depressed to form recesses 25. Each of the recesses 25 is provided at a position above the corresponding bearing surface 19. In order to attain a sufficient dimension in the front-back direction of the engine for each bearing surface 19, each recess 25 is disposed above the crankshaft bearing surface 19 by a predetermined distance $\Delta S$ and is provided in a fan-shaped region about the crankshaft bearing surface 19.

In the fourth embodiment, the bulkheads 26 of the highly-rigid bearings 11*b* and 11*d* have no recesses as in FIG. 13 or may be provided with recesses having smaller area and depth than the recesses 25 provided in the first, third, and fifth crankshaft bearings 11*a*, 11*c* and 11*e*. The recesses 25 allow for thickness reduction in the front-back direction of the engine and reduction in the rigidity of the corresponding crankshaft bearing surfaces 19 so that the rigidity of the highly-rigid bearings 11*b* and 11*d* is relatively increased. Consequently, the force received by the highly-rigid bearings 11*b* and 11*d* can be reduced as in the first and second embodiments.

In particular, in this embodiment, since the recesses 25 are provided above the corresponding crankshaft bearing surfaces 19, the rigidity can be reduced locally and intensively in the vertical direction of the pistons, which is the direction in which a maximum force is exerted. Accordingly, in comparison to the crankshaft bearings 11*a*, 11*c* and 11*e* that are provided with the recesses 25, the rigidity of the second and fourth crankshaft bearings 11*b* and 11*d* in the vertical direction of the pistons is effectively increased, such that sufficient bearing strength is attained and reduced weight and dimensions are achieved at a higher level.

In addition, similar to the second and third embodiments, the crankshaft bearings 11*a* to 11*e* may be arranged along the front-back direction of the engine, such that a common component such as a bearing metal can be used and the design and manufacturing of the cylinder block 12 and the crankshaft 4 can be simplified.

Except for the recess 25 in the fifth crankshaft bearing 11*e*, which recess also serves as a back wall for the cylinder block 12, the remaining recesses 25 may be replaced by through holes extending through the corresponding bulkheads 26 in the front-back direction of the engine.

Based on the above description, the distinctive structure and advantages of the present invention will be described below. The elements of the present invention are not limited to those indicated by reference numerals in the drawings, and modifications are permissible within the scope and spirit of the present invention.

The cylinder block 12 has first to fourth cylinders arranged in the cylinder-arrangement direction. In each cylinder, a piston 1 is slidably movable in the vertical direction. The crankshaft 4 extends in the cylinder-arrangement direction below the first to fourth cylinders. The crankshaft 4 includes a plurality ofjournals 4A that are rotatably supported by the cylinder block 12 by using crankshaft bearings 11*a* to 11*e*; a plurality of crankpins 5 disposed between adjacent journals 4A; and a piston-crank mechanism that links each crankpin 5 with the piston pin 2 of the corresponding piston 1.

According to the piston-crank mechanism, an upward inertia force C near the top dead center of each piston is set lower than a downward inertia force D near the bottom dead center thereof (see FIG. 12) in order to reduce secondary vibration occurring during operation. In other words, a maximum downward acceleration value of each piston is set lower than a maximum upward acceleration value thereof.

As shown in FIG. 6, such piston-stroke characteristics can be achieved by a multilink-type piston-crank mechanism having a relatively simple structure in which each piston pin and the corresponding crankpin are linked by using two links 3 and 6. However, in an internal combustion engine having such piston-stroke characteristics, when two adjacent cylinders are in a relationship such that when the piston in one of the cylinders is near the top dead center and the piston in the other cylinder is near the bottom dead center, the total force (i.e. sum of) of inertia forces of the two adjacent cylinders becomes a downward force during combustion of the one of the cylinders. For example, in a four-cycle inline four-cylinder internal combustion engine having a plurality of crankshaft bearings 11*a* to 11*e*, the engine performing combustion every 180° of crank angle in the order, first, third, fourth, and second cylinders, the crankshaft bearing 11*b* (disposed between the first and second cylinders) and the crankshaft bearing 11*d* (disposed between the third and fourth cylinders) receive the total downward force during combustion of the one of adjacent cylinders, and this force is added to a downward force produced as a result of combustion pressure. Consequently, assuming that all the crankshaft bearings 11*a* to 11*e* have the same dimensions and rigidity, each of the crankshaft bearings 11*b* and 11*d* will receive a locally larger maximum force (than the forces operative on the crankshaft bearings 11*a* and 11*c* and 11*e*). In other words, a maximum force that exceeds the force produced as a result of combustion pressure of the one of adjacent cylinders is exerted on the crankshaft bearings 11*b* and 11*d*, making it difficult to attain sufficient bearing strength for these crankshaft bearings (11*b* and 11*d*). Any attempt to increase the rigidity of all the crankshaft bearings, such that that the bearings 11*b* and 11*d* have sufficient bearing strength, will result in an increase in weight and size.

Therefore, the crankshaft bearings 11*b* and 11*d* are given higher rigidity than the remaining crankshaft bearings 11*a* and 11*c* and 11*e*. As described above, of adjacent crankshaft bearings, the crankshaft bearing that is subject to greater deformation tends to receive a greater percentage of force distributed to the crankshaft bearings. Therefore, by increasing the rigidity of the highly-rigid bearings 11*b* and 11*d* that are assumed to receive a large force, the bearing strength thereof is increased and the deformation thereof is alleviated. This lowers the percentage of force distributed to the highly-rigid bearings 11*b* and 11*d*. By achieving an appropriate distributed-force percentage, the actual force acting on the highly-rigid bearings 11*b* and 11*d* is reduced so that the unevenness in forces acting on the crankshaft bearings 11*a* to 11*e* can be reduced or counterbalanced. Accordingly, the bearing strength can be effectively increased while preventing an increase in weight and size.

Figure 2:
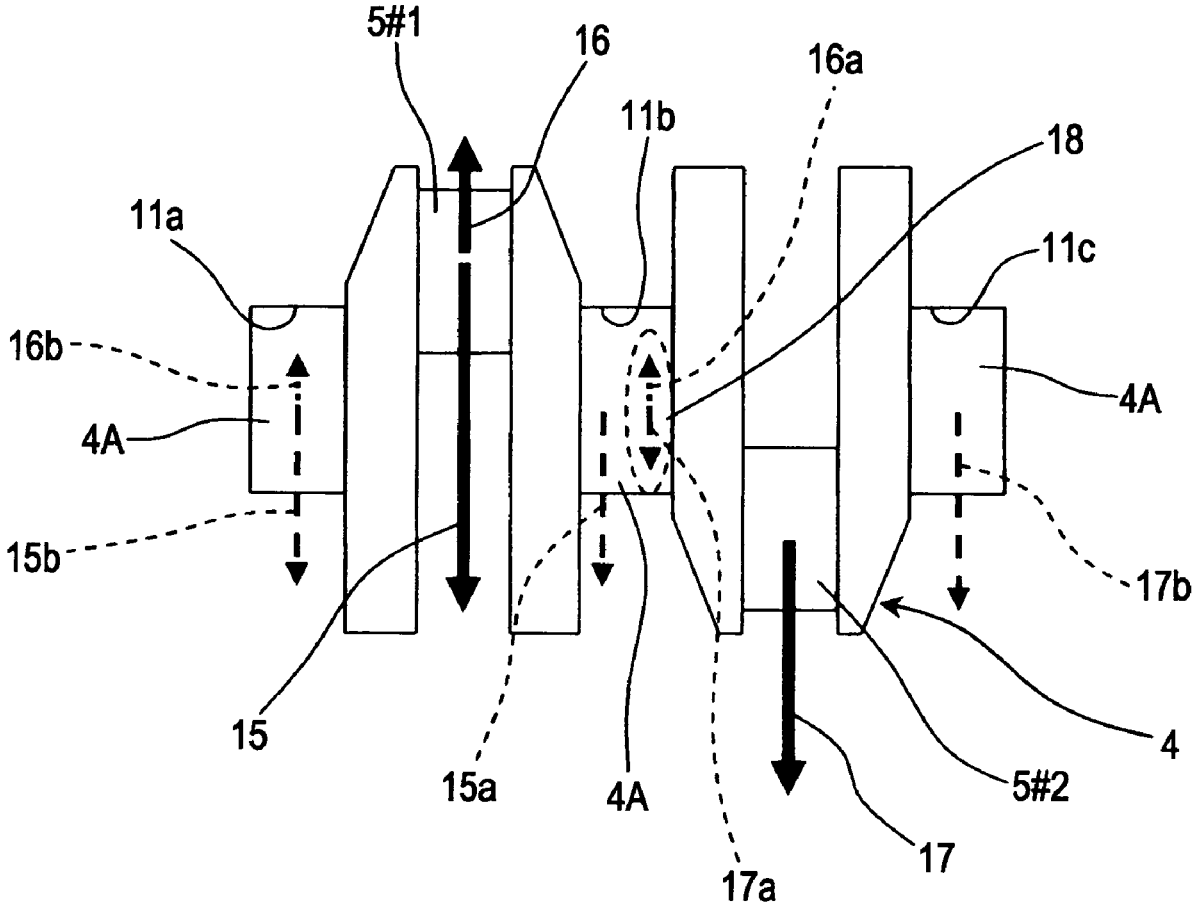
FIG. 2 is a part of the crankshaft in which forces acting on the crankshaft resulting from combustion pressure in first and second cylinders is illustrated in accordance in the first embodiment of the present invention.

More specifically, referring to FIG. 2, the first and second cylinders that are adjacent to each other are in a relationship in which the downward inertia force 17 of the second cylinder is greater than the upward inertia force 16 of the first cylinder during combustion of the first cylinder, and the crankshaft bearing 11*b* disposed between the first and second cylinders has higher rigidity than crankshaft bearings 11*a* and 11*c*. In other words, the crankshaft bearing that receives a force that is larger than a force produced as a result of combustion pressure of one of adjacent cylinders is given higher rigidity than the other crankshaft bearings.

Preferably, as in the second to fourth embodiments shown in FIGS. 3 to 5, the highly-rigid bearings 11*b* and 11*d* are given locally higher rigidity in the vertical direction of the pistons, which is the direction in which a maximum force is exerted. Accordingly, the rigidity of the highly-rigid bearings 11*b* and 11*d* is effectively increased but an increase in weight and size resulting from unnecessarily increasing the rigidity in other directions is prevented.

In a four-cycle inline four-cylinder internal combustion engine, four cylinders, namely, first to fourth cylinders, and five crankshaft bearings 11*a* to 11*e* are arranged in the front-back direction of the engine. The second and fourth crankshaft bearings 11*b* and 11*d* from the front of the engine serve as highly-rigid bearings having higher rigidity than the first, third, and fifth crankshaft bearings 11*a*, 11*c* and 11*e* from the front of the engine.

More specifically, the radial rigidity of the third crankshaft bearing 11*c* from the front the internal combustion engine is lower than the radial rigidity of the second crankshaft bearing 11*b* and the fourth crankshaft bearing 11*d* from the front of the internal combustion engine. Thus, the degree of deformation of the third crankshaft bearing 11*c* in the radial direction thereof, which is caused by an inertia force of the second cylinder or the fourth cylinder, becomes greater than the degree of deformation of the second or fourth crankshaft bearings 11*b* and 11*d*. Consequently, the distributed force received by the third crankshaft bearing 11*c* increases, whereas the distributed force received by the second crankshaft bearing 11*b* and the fourth crankshaft bearing 11*d* (in response to the inertia force of the second and third cylinders respectively) decrease. Accordingly, this prevents the second and fourth crankshaft bearings 11*b* and 11*d* from receiving an excessive force.

Furthermore, the radial rigidity of the first crankshaft bearing 11*a* (at the front of the internal combustion engine) is lower than the radial rigidity of the second crankshaft bearing 11*b* from the front of the internal combustion engine. Therefore, the degree of deformation of the first crankshaft bearing 11*a* in the radial direction thereof caused by an inertia force of the first cylinder becomes greater than the degree of deformation of the second crankshaft bearing 11*b*. Consequently, the distributed force received by the first crankshaft bearing 11*a* increases, whereas the distributed force received by the second crankshaft bearing 11*b* in response to the inertia force of the first cylinder decreases. Accordingly, this prevents the second crankshaft bearing 11*b* from receiving an excessive force.

Furthermore, the radial rigidity of the fifth crankshaft bearing 11*e* from the front of the internal combustion engine is lower than the radial rigidity of the fourth crankshaft bearing 11*d* from the front of the internal combustion engine. Therefore, the degree of deformation of the fifth crankshaft bearing 11*e* in the radial direction thereof caused by an inertia force of the fourth cylinder becomes greater than the degree of deformation of the fourth crankshaft bearing 11*d*. Consequently, the distributed force received by the fifth crankshaft bearing 11*e* increases, whereas the distributed force received by the fourth crankshaft bearing 11*d* in response to the inertia force of the fourth cylinder decreases. Accordingly, this prevents the fourth crankshaft bearing 11*d* in the multilink-type internal combustion engine from receiving an excessive force.

Furthermore, the vertical rigidity (i.e. the rigidity in the vertical direction of the pistons) of the third, first, or fifth crankshaft bearings 11*c*, 11*a*, or 11*e* from the front of the internal combustion engine is lower than the vertical rigidity of the second crankshaft bearing 11*b* and the fourth crankshaft bearing 11*d* from the front of the internal combustion engine. Thus, the force-reducing effect on the second and fourth crankshaft bearings 11*b* and 11*d* is notably achieved particularly in the vertical direction, which is the direction in which a maximum force is exerted on the crankshaft bearings 11*b* and 11*d*.

In the first embodiment shown in FIGS. 1 and 2, the dimension D2 in the front-back direction of the engine for the third, first, or fifth crankshaft bearings 11*c*, 11*a*, or 11*e* from the front of the internal combustion engine is smaller than the dimension D1 in the front-back direction of the engine for the second crankshaft bearing 11*b* and the fourth crankshaft bearing 11*d* so that the rigidity of the third, first, or fifth crankshaft bearings 11*c*, 11*a*, or 11*e* is lower than that of the second and fourth crankshaft bearings 11*b* and 11*d*. Thus, the aforementioned force-reducing effect is achieved. In this case, the third, first, or fifth crankshaft bearings 11*c*, 11*a*, or 11*e*, that receive less force than the second and fourth crankshaft bearings 11*b* and 11*d*, are reduced in width, such that the dimension of the engine in the front-back direction can be reduced.

In the second to fourth embodiments shown in FIGS. 3 to 5, the second and fourth crankshaft bearings 11*b* and 11*d* from the front of the engine serve as highly-rigid bearings having higher rigidity in the vertical direction of the pistons, i.e. the direction in which a maximum force is exerted, as compared with the rigidity of the first, third, and fifth crankshaft bearings 11*a*, 11*c* and 11*e* from the front of the engine. Accordingly, an aforementioned force-reducing effect on the highly-rigid bearings can be properly achieved whilst preventing an increase in weight and size resulting from an unnecessary increase in the rigidity in other directions.

In a multilink engine, the acceleration of each piston near the top dead center thereof is set lower than that in a single-link engine. Thus, as compared with single-link engines, secondary vibration occurring during operation of each piston is reduced, and moreover, the piston-stroke rate can be set relatively low near the top dead center and relatively high near the bottom dead center. Setting a low piston-stroke rate near the top dead center of each piston means lowering the rate of increase in the combustion chamber capacity within a crank-angle range for the first half of an expansion stroke. Therefore, the degree of pressure drop in the combustion chamber within this crank-angle range is reduced, whilst the degree of temperature drop in the combustion chamber is simultaneously reduced. Consequently, the combustion rate for the first half of an expansion stroke can be maintained at a high rate, thereby effectively reducing the length of the combustion period. As a result, even during a high-load operation, in which a large amount of intake air is supercharged into the combustion chamber using, for example, a supercharger, the exhaust gas temperature is prevented from increasing drastically. Moreover, the amount of air-fuel mixture that bums within the crank-angle range for the first half of an expansion stroke increases so that the percentage thereof that is effectively converted to engine output increases. Accordingly, the thermal efficiency of the engine is improved.

Furthermore, there is readily provided a function for changing the compression ratio of the engine by altering the position of the rocking fulcrum (control cam 7A) for each control link 8 to change the position of the top dead center of the corresponding piston with respect to the multilink mechanism. In detail, referring to FIGS. 2 and 3, there is provided the control shaft 7 rotatably supported by the cylinder block 12, the control cams 7A disposed eccentrically to the control shaft 7 and attached to the first ends of the corresponding control links 8, and the variable-compression-ratio actuator 31 for changing or maintaining the rotation angle of the control shaft 7. By changing the rotational position of the control shaft 7, the control cams 7A serving as rocking fulcrums for the control links 8 rotate around the control shaft 7 so as to change the engine compression ratio.

In the second embodiment shown in FIG. 3, each of the highly-rigid bearings 11*b* and 11*d* has the housing 24 of the variable-compression-ratio actuator 31 fastened thereto in order to increase the rigidity of the highly-rigid bearings 11*b* and 11*d*. More specifically, a plurality of film-like bulkheads 26 integrally provided in the cylinder block 12 and the ladder frame 13 fixed to the lower surfaces of the bulkheads 26 are provided. The ladder frame 13 is provided with a plurality of first bearing caps 27 that rotatably support the journals 4A of the crankshaft 4 together with the bulkheads 26. Moreover, there are also provided second bearing caps 14 which are fixed to the lower surface of the ladder frame 13 and rotatably support the control shaft 7 together with the ladder frame 13. Furthermore, the second bearing caps 14*a* that are positioned below the highly-rigid bearings 11*b* and 11*d* each have the housing 24 of the variable-compression-ratio actuator 31 fixed thereto. Consequently, the housing 24 is used as a rigid reinforcing member, thereby effectively increasing the rigidity of the highly-rigid bearings with a simple structure, particularly, the rigidity thereof in the vertical direction of the pistons.

In the second and third embodiments shown in FIGS. 3 and 4, the second bearing caps 14*a* disposed below the highly-rigid bearings 11*b* and 11*d* are highly-rigid bearing caps that are longer in the width direction of the engine than the remaining second bearing caps 14. Accordingly, with a simple structure that utilizes the highly-rigid bearing caps 14*a* rotatably supporting the control shaft 7, the rigidity of the highly-rigid bearings 11*b* and 11*d*, particularly, the rigidity thereof in the vertical direction of the pistons, can be effectively increased.

Furthermore, according to the second and third embodiments shown in FIGS. 3 and 4, in order to further increase the bearing strength of the highly-rigid bearings 11*b* and 11*d*, a total of three fastening bolts 21 to 23, including the two fastening bolts 21 and 22 that are disposed on opposite sides of each journal 4A of the crankshaft 4, are provided at each of the sections corresponding to the highly-rigid bearings 11*b* and 11*d*. The three fastening bolts 21 to 23 are used for fastening each second bearing cap 14*a* and the ladder frame 13 together to the corresponding bulkhead 26.

In the fourth embodiment shown in FIG. 5, excluding the highly-rigid bearings 11*b* and 11*d*, the remaining crankshaft bearings 11*a*, 11*c* and 11*e* are provided with the recesses 25 (or through holes) on the side surfaces thereof in the front-back direction of the engine in order to reduce the rigidity thereof. This enables the highly-rigid bearings 11*b* and 11*d* to have relatively higher rigidity than the crankshaft bearings 11*a*, 11*c* and 11*e* provided with the recesses 25. In this case, all the crankshaft bearings 11*a* to 11*e* can be given the same dimension in the front-back direction of the engine while giving different rigidities to the crankshaft bearings. Therefore, the design and manufacturing of the crankshaft 4 and the cylinder block 12 can be simplified and a common component such as a bearing metal can be used. Furthermore, since the crankshaft bearings 11*a*, 11*c* and 11*e* other than the highly-rigid bearings 11*b* and 11*d* are provided with the recesses 25 or through holes, the dimension of the crankshaft bearings in the vertical direction of the pistons, which is the direction in which a maximum force is exerted, is locally reduced, thereby reducing the received force in the vertical direction of the pistons. Accordingly, the rigidity of the highly-rigid bearings 11*b* and 11*d* in the vertical direction of the pistons can be relatively and effectively increased.

The preceding description has been presented only to illustrate and describe possible embodiments of the claimed invention. It is not intended to be exhaustive or to limit the invention to any precise form disclosed. It will be understood by those skilled in the art that various changes may be made and equivalents may be substituted for elements thereof without departing from the spirit and scope of the invention. Therefore, it is intended that the invention not be limited to the particular embodiments disclosed as the best mode contemplated for carrying out this invention but that the invention can widely be adapted to multi-cylinder internal combustion engines with an array of a plurality of cylinders formed with various layouts and will include all embodiments falling within the scope of the appended claims.

What is claimed is:

1. An internal combustion engine comprising:

a cylinder block having a plurality of cylinders;

a plurality of pistons with one of the pistons being slidable disposed in one of the cylinders to move between a top dead center and a bottom dead center, each of the pistons including a piston pin;

a crankshaft disposed below the cylinders and extending in a direction in which the cylinders are arranged, the crankshaft including a plurality of journals and a plurality of crankpins disposed between adjacent pairs of the journals;

a plurality of crankshaft bearings rotatably supporting the crankshaft on the cylinder block via the journals; and a piston-crank mechanism linking the crankshaft and the pistons together by the crankpins and the piston pins, the piston-crank mechanism being configured and arranged such that an upward inertia force is produced near the top dead center of each of the pistons that is smaller than a downward inertia force produced near the bottom dead center of the pistons, at least one but less than all of the crankshaft bearings being disposed between an adjacent pair of the cylinders, the adjacent pair of the cylinders having a relationship in which one of the pistons in one of the adjacent pair of the cylinders is near the top dead center when the other of the pistons in the other of the adjacent pair of the cylinders is near the bottom dead center, and the at least one but less than all of crankshaft bearings having a higher rigidity than remaining ones of the crankshaft bearings.

2. The internal combustion engine according to claim 1, wherein the piston-crank mechanism comprises a multilink-type piston-crank mechanism that includes:

upper links coupled to the piston pins of the pistons;

lower links coupled to the upper links and to the crankpins of the crankshaft; and control links each having a first end rockably supported by the cylinder block about a rocking fulcrum and a second end coupled to the corresponding one of the lower links.

3. The internal combustion engine according to claim 2, further comprising a compression-ratio changing mechanism comprising a control shaft rotatably supported by the cylinder block, a plurality of control cams disposed eccentrically to the control shaft and attached to the first ends of the control links, and a variable-compression-ratio actuator for changing or maintaining a rotation angle of the control shaft, the compression-ratio changing mechanism being arranged to change a compression ratio of the engine by altering a position of each of the rocking fulcrums in order to change a position of the top dead center of a corresponding one of the pistons, and the variable-compression-ratio actuator having a housing that is fixed to the at least one but less than all of crankshaft bearings having the higher rigidity than the remaining ones of the crankshaft bearings.

4. The internal combustion engine according to claim 3, further comprising a plurality of film-like bulkheads integrally provided in the cylinder block; and a ladder frame fixed to lower surfaces of the bulkheads, the ladder frame comprising a plurality of first bearing caps that rotatably support the journals of the crankshaft together with the bulkheads, and a plurality of second bearing caps fixed to a lower surface of the ladder frame and rotatably supporting the control shaft together with the ladder frame, and the variable-compression-ratio actuator having a housing that is fixed to at least one of the second bearing caps that is positioned below the at least one but less than all of crankshaft bearings having the higher rigidity.

5. The internal combustion engine according to claim 2, further comprising a compression-ratio changing mechanism comprising a control shaft rotatably supported by the cylinder block, a plurality of control cams disposed eccentrically to the control shaft and attached to the first ends of the control links, and a variable-compression-ratio actuator for changing or maintaining a rotation angle of the control shaft, the compression-ratio changing mechanism being arranged to change a compression ratio of the engine by altering a position of each of the rocking fulcrums in order to change a position of the top dead center of a corresponding one of the pistons.

6. The internal combustion engine according to claim 5, further comprising a plurality of film-like bulkheads integrally provided in the cylinder block; and a ladder frame fixed to lower surfaces of the bulkheads, the ladder frame comprising a plurality of first bearing caps that rotatably support the journals of the crankshaft together with the bulkheads, and a plurality of second bearing caps fixed to a lower surface of the ladder frame and rotatably supporting the control shaft together with the ladder frame, the control shaft being disposed obliquely below the crankshaft, and at least one of the second bearing caps that is positioned below the at least one but less than all of crankshaft bearings having the higher rigidity being longer in a width direction of the engine than remaining ones of the second bearing caps.

7. The internal combustion engine according to claim 6, further comprising at least two fastening bolts disposed on opposite sides of each of the journals of the crankshaft, the at least two fastening bolts fastening the ladder frame and the at least one of the second bearing caps that is longer in the width direction of the engine than the remaining ones of the second bearing caps together to the corresponding bulkhead.

8. The internal combustion engine according to claim 1, wherein the at least one but less than all of crankshaft bearings having the higher rigidity than the remaining ones of the crankshaft bearings is larger in a front-back direction of the engine than the remaining ones of the crankshaft bearings.

9. The internal combustion engine according to claim 8, wherein the remaining ones of the crankshaft bearings are provided with recesses or through holes on side surfaces thereof in the front-back direction of the engine.

10. The internal combustion engine according to claim 1, wherein each of the crankshaft bearing comprises a bulkhead having side surfaces with the side surfaces of at least one of the remaining ones of the crankshaft bearings being partially depressed to form a recess.

11. The internal combustion engine according to claim 10, wherein the cylinders comprises four cylinders arranged in a front-back direction of the internal combustion engine, and the crankshaft bearings comprises first, second, third, fourth and fifth crankshaft bearings arranged in the front-back direction with the first crankshaft bearing being disposed towards a front end of the engine, the fifth crankshaft bearing being disposed towards a rear end of the engine and the second, third and fourth crankshaft bearings being arranged in numerical order between the first and fifth crankshaft bearings in the front-back direction, and the remaining ones of the crankshaft bearings comprise the first, third and fifth crankshaft bearings which have a recess in their side surfaces of the bulkheads.

12. The internal combustion engine according to claim 1, wherein each of the crankshaft bearing comprises a bulkhead having side surfaces and the side surfaces of at least one of the remaining ones of the crankshaft bearings comprises a through hole.

13. The internal combustion engine according to claim 12, wherein the cylinders comprises four cylinders arranged in a front-back direction of the internal combustion engine, and the crankshaft bearings comprises first, second, third, fourth and fifth crankshaft bearings arranged in the front-back direction, with the first crankshaft bearing being disposed towards a front end of the engine, the fifth crankshaft bearing being disposed towards a rear end of the engine and the second, third and fourth crankshaft bearings being arranged in numerical order between the first and fifth crankshaft bearings in the front-back direction, and the remaining ones of the crankshaft bearings comprise the first and third crankshaft bearings which have a through hole in their side surfaces.

14. The internal combustion engine according to claim 1, wherein the piston-crank mechanism is arranged to allow a maximum downward acceleration value of each of the pistons to be smaller than a maximum upward acceleration value of the pistons.

15. The internal combustion engine according to claim 1, wherein the higher rigidity of the at least one but less than all of crankshaft bearings is higher than the remaining ones of the crankshaft bearings in a vertical direction of the pistons.

16. The internal combustion engine according to claim 1, wherein the cylinders comprises four cylinders arranged in a front-back direction of the internal combustion engine, and the crankshaft bearings comprises first, second, third, fourth and fifth crankshaft bearings arranged in the front-back direction with the first crankshaft bearing being disposed towards a front end of the engine, the fifth crankshaft bearing being disposed towards a rear end of the engine and the second, third and fourth crankshaft bearings being arranged in numerical order between the first and fifth crankshaft bearings in the front-back direction, and the second and fourth crankshaft bearings have the higher rigidity than the first, third and fifth crankshaft bearings.

17. An internal combustion engine comprising:

a cylinder block having a plurality of cylinders;

a plurality of pistons with one of the pistons being slidable disposed in one of the cylinders to move between a top dead center and a bottom dead center, each of the pistons including a piston pin;

a crankshaft disposed below the cylinders and extending in a direction in which the cylinders are arranged, the crankshaft including a plurality of journals and a plurality of crankpins disposed between adjacent pairs of the journals;

a plurality of crankshaft bearings rotatably supporting the crankshaft on the cylinder block via the journals; and a piston-crank mechanism linking the crankshaft and the pistons together by the crankpins and the piston pins, the piston-crank mechanism being configured and arranged such that an upward inertia force is produced near the top dead center of each of the pistons that is smaller than a downward inertia force produced near the bottom dead center of the pistons, and at least one but less than all of the crankshaft bearings being disposed between an adjacent pair of the cylinders has a rigidity higher than the remaining ones of the crankshaft bearings, with the adjacent pair of cylinders having a relationship in which forces acting on the crankshaft resulting from combustion pressure in the adjacent pair of cylinders result in an upward inertia force in one of the adjacent pair of cylinders that is smaller than a downward inertia force of the other ones of the adjacent pair of the cylinders during combustion of the one of the adjacent pair of cylinders.

18. An internal combustion engine comprising:

a cylinder block having a plurality of cylinders;

a plurality of pistons with one of the pistons being slidable disposed in one of the cylinders to move between a top dead center and a bottom dead center, each of the pistons including a piston pin;

a crankshaft disposed below the cylinders and extending in a direction in which the cylinders are arranged, the crankshaft being rotatably supported by a plurality of crankshaft bearings provided in the cylinder block, the crankshaft including a plurality of journals rotatably supported by the crankshaft bearings and a plurality of crankpins disposed between adjacent pairs of the journals; and a piston-crank mechanism linking the crankpins with the piston pins, at least one but less than all of the crankshaft bearings configured and arranged to receive a force greater than a force produced in response to a maximum combustion pressure by a predetermined one of the cylinders has a rigidity higher than that of remaining ones of the crankshaft bearings.

* * * * *